US005350665A

United States Patent [19]

Hasebe et al.

[11] Patent Number: 5,350,665

[45] **Date of Patent: * Sep. 27, 1994**

[54] SILVER HALIDE COLOR PHOTOGRAPHIC MATERIAL

[75] Inventors: Kazunori Hasebe; Shigeaki Otani; Yasuhiro Hayashi, all of Kanagawa, Japan

[73] Assignee: Fuji Photo Film Co., Ltd., Kanagawa, Japan

[ * ] Notice: The portion of the term of this patent subsequent to Feb. 15, 2011 has been disclaimed.

[21] Appl. No.: 800,104

[22] Filed: Nov. 29, 1991

[30] Foreign Application Priority Data

Nov. 30, 1990 [JP] Japan ..... 2-334785
Nov. 30, 1990 [JP] Japan ..... 2-334788
Nov. 30, 1990 [JP] Japan ..... 2-334796

[51] Int. Cl.[5] ..... G03C 1/08

[52] U.S. Cl. ..... 430/508; 430/538; 430/576; 430/588; 430/503; 430/603; 430/605

[58] Field of Search ..... 430/508, 538, 576, 588, 430/603, 605, 503

[56] References Cited

U.S. PATENT DOCUMENTS

| | | | |
|---|---|---|---|
| 4,837,140 | 6/1989 | Ikeda et al. | 430/550 |
| 5,021,328 | 6/1991 | Takahashi et al. | 430/502 |
| 5,057,405 | 10/1991 | Shiba et al. | 430/505 |
| 5,077,183 | 12/1991 | Reuss et al. | 430/605 |
| 5,135,845 | 8/1992 | MacIntyre et al. | 430/588 |
| 5,183,731 | 2/1993 | Takahashi et al. | 430/505 |

*Primary Examiner*—Charles L. Bowers, Jr.
*Assistant Examiner*—Geraldine Letscher
*Attorney, Agent, or Firm*—Sughrue, Mion, Zinn, Macpeak & Seas

[57] ABSTRACT

A silver halide color photographic material comprising a reflective support having thereon a yellow dye image forming silver halide emulsion layer, a magenta dye image forming silver halide emulsion layer and a cyan dye image forming silver halide emulsion layer, wherein said yellow dye image forming layer, magenta dye image forming layer and cyan dye image forming layer exhibit a maximum spectral sensitivity in the range of 400 to 490 nm, 530 to 570 nm and 660 to 720 nm, respectively, said silver halide emulsion of said cyan dye image forming layer comprises a silver chloride, silver bromochloride or silver bromochloroiodide emulsion having a silver chloride content of 90 mol % or more with a maximum spectral sensitivity given by J-band absorption of a compound represented by the general formula (I), (I)

wherein the variables are described in the specification.

9 Claims, No Drawings

SILVER HALIDE COLOR PHOTOGRAPHIC MATERIAL

FIELD OF THE INVENTION

The present invention relates to a silver halide color photographic material which exhibits an excellent sharpness, particularly cyan image sharpness, excellent whiteness in the nonimage area, high sensitivity and excellent rapid-developability. More particularly, the present invention relates to a color photographic paper which has these properties. Further, the present invention relates to a silver halide color photographic material which exhibits an excellent image sharpness, high sensitivity, excellent rapid-developability and stable photographic properties against changes in humidity upon exposure. More particularly, the present invention relates to a color print light-sensitive material which has these properties.

BACKGROUND OF THE INVENTION

Recently, more rapid processing of silver halide color photographic materials, particularly print light-sensitive materials, has been desired. On the other hand, high quality images are also needed.

In order to meet these demands, a number of techniques have been proposed. It is known that more rapid processing can be preferably accomplished by the use of a silver bromochloride emulsion with a high silver chloride content as the silver halide emulsion, as disclosed in WP-A-87-04534 and JP-A-64-26837 (the terms "WP-A" and "JP-A" as used herein mean an "unexamined published Japanese patent application" and "unexamined published International patent application", respectively).

In order to provide high quality images, many studies have been made on improvements in image sharpness. These studies have been actually put into practical use.

Factors affecting image sharpness of a silver halide photographic material are generally known to involve irradiation and halation. Irradiation is attributed to the scattering of incident light by sliver halide grains dispersed in a gelatin layer while the halation is attributed to the scattering of light by the support.

A general description of these factors is set forth in detail. T. H. James, *The Theory of the Photographic Process,* 4th ed., pp. 578–591 (Macmillan Publishing Co., Ltd. 1977).

In particular, in a silver photographic material comprising a reflective support, halation from the support causes a remarkable deterioration in image sharpness. Many studies have been previously made to inhibit this phenomenon. For example, U.S. Pat. Nos. 2,548,564, and 3,625,694, JP-A-56-12639, JP-A-63-197943, and JP-A-l-188850, and European Patent 0 337 490 A2 disclose that the coloring of the layers of the photographic light-sensitive material with a water-soluble dye inhibits halation. This approach has been put into practical use. However, if a large amount of such a water-soluble dye is used to further improve sharpness, this is disadvantageous because the fluctuation in the photographic properties becomes great or the unexposed area of the silver halide color photographic material is greatly stained after continuous processing of light-sensitive materials. Therefore, this approach is not practical.

A layer containing a white pigment can be effectively coated on the support to eliminate the deterioration of sharpness. This approach is further described in, e.g., JP-B-58-43734 (the term "JP-B" as used herein means an "examined Japanese patent publication"), and JP-A-58-17433, JP-A-58-14830, and JP-A-61-259246. However, it was found that if a white pigment is incorporated in the system in such a manner that the image sharpness is sufficiently improved, the physical strength of the layer against "bending" is deteriorated and it becomes difficult to achieve a smooth surface upon coating. Further, U.S. Pat. Nos. 2,548,564, and 3,625,694, JP-A-56-12639, JP-A-63-197943, and JP-A-l-188850, and European Patent 0 337 490 A2 disclose that image sharpness can be also improved by coloring the layers of the photographic light-sensitive material with a dye or the like. However, it was found that if the amount of the dye is increased to improve image sharpness, the fluctuation in the photographic properties after continuous processing of light-sensitive materials becomes great, and, moreover, the white background is greatly stained after processing. Therefore, the amount of the dye cannot be increased to a value such that image sharpness is sufficiently improved. Stain on the white background in a silver halide color photographic material not only deteriorates the whiteness of the background but also worsens color stain of dye images and impairs visual sharpness. In particular, in a reflective material, stain reflection density is theoretically increased several times the transmission density. Therefore, even a minute stain can impair the image quality. Thus, stain of the white background is a very important factor.

Approaches for improving the dyes used for inhibiting irradiation disclosed in JP-A-50-145125, JP-A-52-20830, JP-A-50-147712, JP-A-59-111641, JP-A-61-148448, JP-A-61-151538, JP-A-61-151649, JP-A-61-151650, JP-A-61-151651, JP-A-61-170742, JP-A-61-175638, JP-A-61-235837, JP-A-61-248044, JP-A-62-164043, JP-A-62-253145, JP-A-62-253146, JP-A-62-253142, JP-A-62-275262, JP-A-62-283336, JP-A-62-275262, and JP-A-62-283336, and *Research Disclosure,* Nos. 17643 (page 22, December 1978), and 18716 (page 647, November 1979), in view of an improvement of sharpness. An approach is also known which comprises providing an antihalation (AH) layer in a color light-sensitive material for this purpose. This approach is further described in U.S. Pat. Nos. 2,326,057, 2,882,156, 2,839,401, and 3,706,563, and JP-A-55-33172, JP-A-59-193447, and JP-A-62-32448.

JP-A-63-286849 discloses that the optical reflection density when these diffusion dyes or coloring agents such as an AH are used can be controlled to a predetermined value.

However, if the optical reflection density is increased, not only is sharpness improved but also sensitivity is deteriorated. Thus, it is difficult to improve sharpness while maintaining a practically sufficient sensitivity only using this approach. In order to improve the optical reflection density, it is necessary to use a large amount of such a dye. However, if a large amount of such a dye is used, gradation is softened, and dye remains even after processing to deteriorate the whiteness of the nonimage area. This is one of the reasons why a high reflection density sufficient for practical use cannot be achieved. The approach which comprises providing an antihalation layer requires that another layer be added to the layer structure, and this adds difficulty in the manufacture of the light-sensitive material.

Due to these difficulties, improvements have been studied also in support materials. A baryta paper has heretofore been used as a support for color print light-sensitive materials. In recent years, a water-resistant support comprising a paper laminated with polyethylene on both sides thereof has been used. In order to obtain the sharpness of a printed image as obtained in using a baryta paper, titanium oxide or zinc oxide is dispersed in the polyethylene layer. However, this arrangement results in markedly less quality than achieved with the baryta paper which has heretofore been used. Improvements in the polyethylene layer is further described in JP-B-58-43734, and JP-A-58-17433, JP-A-58-14830, and JP-A-61-259246.

A process which comprises coating a paper with a coating solution containing an unsaturated organic compound polymerizable by electron rays containing one or more double bonds per molecule and a white pigment, and then irradiating the material with electron rays at an elevated temperature so that it is cured to provide a water-resistant resin layer on the paper is disclosed in JP-A-57-27257, JP-A-57-49946, JP-A-61-262738, and JP-A-62-61049.

A silver halide photographic material comprising a support having a mirror-like reflectivity or second diffusion reflectivity is known. It is disclosed in JP-A-63-24251 and JP-A-63-24253.

In a reflection type color photographic material, the rate of the development of image sharpness is generally determined by the cyan image. Even if a large amount of anti-irradiation dye is used, the effect of the cyan image on the other color layers does not occur. This is considered a phenomenon which occurs due to the high linearity of advance of red light. Red light greatly penetrates upon exposure and observation. However, the improvement in support materials and the addition of dyes cannot sufficiently meet the increasing demand for improved cyan image sharpness. It has thus been desired to provide further improvements in these techniques.

SUMMARY OF THE INVENTION

Therefore an object of the present invention is to provide a silver halide color photographic material, particularly a color photographic paper, which exhibits a high sharpness, excellent whiteness in the nonimage area, high sensitivity and excellent rapid-developability.

Another object of the present invention is to provide a process for the formation of a color image which rapidly provides a color photograph with high sharpness and an excellent whiteness in the nonimage area.

A further object of the present invention is to provide a silver halide photographic material which exhibits excellent cyan image sharpness and a high degree of photographic stability against humidity changes upon exposure.

These and other objects of the present invention will become more apparent from the following detailed description and examples of the present invention.

The inventors found that these objects of the present invention are effectively accomplished by improvements in a process for the spectral sensitization of silver halide emulsions and by specifying a preferred reflection density, support material, and sulfite ion concentration in the color developer as defined below.

In one embodiment, this invention provides a silver halide color photographic material comprising a reflective support having thereon a yellow dye image forming layer, a magenta dye image forming layer and a cyan dye image forming layer, wherein the yellow dye image forming layer, the magenta dye image forming layer and the cyan dye image forming layer exhibit a maximum spectral sensitivity in the range of 400 to 490 nm, 530 to 570 nm and 660 to 720 nm, respectively, the cyan dye image forming layer comprises a silver chloride, silver bromochloride or silver bromochloroiodide emulsion having a silver chloride content of 90 mol % or more with a maximum spectral sensitivity given by J-band absorption of a compound represented by the general formula (I),

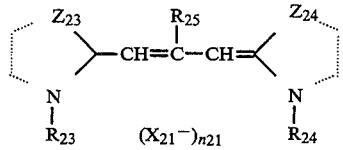

(I)

wherein $Z_{23}$ and $Z_{24}$ each represents an atomic group required to form a heterocyclic nucleus selected from the group consisting of a benzothiazole nucleus, a benzoselenazole nucleus, a naphthothiazole nucleus and a naphthoselenazole nucleus which may be substituted with one or more of a halogen atom, an alkyl group, an alkoxy group, an aryl group and a hydroxyl group, with the proviso that of these substituents, two alkyl groups may form a ring such as an acenaphthenothiazole ring or acenaphthenoselenazole ring; $R_{25}$ represents a hydrogen atom, an alkyl group or an aryl group; $R_{23}$ and $R_{24}$ each represents a substituted or unsubstituted alkyl group; $X_{21}$ represents an ion necessary for electrical neutrality;

and $n_{21}$ represents an integer 0 or 1, with the proviso that when one of $R_{23}$ and $R_{24}$ forms an intramolecular salt with a quaternized nitrogen atom, $n_{21}$ is 0, and the optical reflection density of the photographic material at 680 nm is 0.70 or more.

In another embodiment, the invention provides a silver halide color photographic material as defined above, wherein the support is a reflective support comprising a hydrophobic resin or a substrate covered by a hydrophobic resin and containing white pigment grains in an amount of 14% by weight or more, preferably 14 to 50% by weight, in the hydrophobic resin layer on the side on which the silver halide emulsion layer is coated.

A futher embodiment provides a silver halide color photographic material as defined above, wherein the support is a reflective support having a second diffusion reflectivity.

Also an embodiment provides a process for the formation of a color photographic image, which comprises exposing to light a silver halide color photographic material comprising a reflective support having thereon a yellow dye image forming layer, a magenta dye image forming layer and a cyan dye image forming layer, wherein the yellow dye image forming layer, the magenta dye image forming layer and the cyan dye image forming layer exhibit a maximum spectral sensitivity in the range of 400 to 490 nm, 530 to 570 nm and 660 to 720 nm, respectively, the cyan dye image forming layer comprises a silver chloride, silver bromochloride or silver bromochloroiodide emulsion having a silver chloride content of 90 mol % or more with a maximum spectral sensitivity given by J-band absorption of a compound represented by the general formula (I)

above, and the optical reflection density of the photographic material at 680 nm is 0.70 or more, and then subjecting the material to color development with a color developer substantially free of sulfite ions.

Additional embodiments include: a process for the formation of a color photographic image as defined above, wherein the support is a reflective support comprising a hydrophobic resin or a substrate covered by a hydrophobic resin and containing white pigment grains in an amount of 14% by weight or more in the hydrophobic resin layer on the side on which the silver halide emulsion layer is coated;

a process for the formation of a color photographic image as defined above, wherein the support is a reflective support having a second diffusion reflectivity;

a silver halide color photographic material as defined above, where the silver bromochloride grains of the cyan dye image forming light-sensitive layer are grains with a silver chloride content of 95 mol % or more comprising a silver bromide localized phase having a silver bromide content of at least 10 mol % in the vicinity of the surface thereof and containing ions of at least one metal selected from the group consisting of group VIII metals, group II transition metals, lead and thallium;

a silver halide color photographic material as defined above, wherein the emulsion of the cyan dye image forming light-sensitive layer is an emulsion sensitized with a sulfur sensitizing compound;

a silver halide color photographic material as defined above, wherein the emulsion of the cyan dye image forming light-sensitive layer is an emulsion sensitized with a gold sensitizing compound;

a silver halide color photographic material as defined above, wherein the emulsion of the cyan dye image forming light-sensitive layer is an emulsion sensitized with a sulfur sensitizing compound and a gold sensitizing compound;

a silver halide color photographic material as defined above, wherein the optical reflection density thereof at 680 nm is 0.50 or more and the total coated amount of the silver halide emulsion on the support is adjusted to 0.78 g/m$^2$ or less, calculated in terms of silver; and a silver halide color photographic material as defined above, wherein the total coated amount of silver halide emulsion in the cyan image forming layer is 0.25 g/m$^2$ or less, calculated in terms of silver.

DETAILED DESCRIPTION OF THE INVENTION

The color photographic light-sensitive material of the present invention comprises at least one blue-sensitive silver halide emulsion layer, at least one green-sensitive emulsion layer and at least one red-sensitive emulsion layer coated on a support. Conventional color photographic papers normally comprise these color-sensitive emulsion layers on a support in this order. The arrangement of these color-sensitive emulsion layers may be varied, if desired. These light-sensitive emulsion layers each comprises a silver halide emulsion with a sensitivity to the respective wavelength ranges and a so-called color coupler which forms a dye complementary to the light to which the layer is sensitive, i.e., yellow for blue, magenta for green and cyan for red so that color is reproduced by the substractive color process. In the present invention, it is necessary that the yellow dye image-forming layer, the magenta dye image-forming layer and the cyan dye image-forming layer exhibit a maximum spectral sensitivity at 400 to 490 nm, 530 to 570 nm and 660 to 720 nm, preferably 440 to 480 nm, 540 to 560 nm and 675 to 710 nm, respectively. These spectral sensitivity ranges are required to obtain a color print from a color negative film using a color printer. If the spectral sensitivity ranges deviate from the above specified ranges, the color hue of the light-sensitive material greatly shifts from that of conventional color negative films, making it impossible to properly reproduce images.

Further, it is necessary for the spectral sensitivity of the cyan image forming layer to be provided by J-band absorption of a compound represented by the general formula (I) as set forth below.

The compound represented by the general formula (I) is further described below.

Preferred examples of functional groups which may be present as substituents on the heterocyclic group formed by $Z_{23}$ or $Z_{24}$ in the general formula (I) include halogen atoms such as fluorine, chlorine and bromine, alkyl groups such as methyl, ethyl and propyl, alkoxy groups such as methoxy, ethoxy and propoxy, and aryl groups such as phenyl and p-tolyl. Preferred examples of groups represented by $R_{25}$ include a hydrogen atom, an alkyl group such as methyl, ethyl, propyl, butyl and phenethyl, and an aryl group such as phenyl. Preferred examples of groups represented by $R_{23}$ and $R_{24}$ include a methyl group, an ethyl group, an n-propyl group, an i-propyl group, a 2-hydroxyethyl group, a 4-hydroxybutyl group, a 2-acetoxyethyl group, a 3-acetoxypropyl group, a 2-methoxyethyl group, a 4-methoxybutyl group, a 2-carboxyethyl group, a 3-carboxypropyl group, a 2-(2-carboxyethoxy)ethyl group, a 2-sulfoethyl group, a 3-sulfopropyl group, a 3-sulfobutyl group, a 4-sulfobutyl group, a 2-hydroxy-3-sulfopropyl group, a 2-(3-sulfopropoxy)ethyl group, a 2-acetoxy-3-sulfopropyl group, a 3-methoxy-2-(3-sulfopropoxy)propyl group, a 2-[2-(3-sulfopropoxy)ethoxy]ethyl group, a 2-hydroxy-3-(3-sulfopropoxy)propyl group, a benzyl group, and a phenethyl group.

Among these heterocyclic substituents, two alkyl groups may form a ring such as an acenaphthenothiazole ring and an acenaphthenoselenazole ring.

J-band absorption represents light absorption due to the formation of J aggregate. The J band of sensitizing dyes are further described in T. H. James, "The Theory of the Photographic Process", (Macmillan Publishing Co., Ltd. 1977).

Specific examples of compound represented by the general formula (I) are described below:

| Mother Skeleton | Compound No. | X | Y | A | A′ | $R_{25}$ | $R_{23}$ | $R_{24}$ | $X_{21}$ | $n_{21}$ |
|---|---|---|---|---|---|---|---|---|---|---|
| 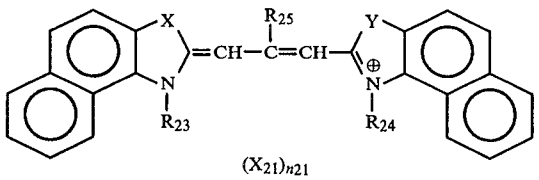 | I-1 | S | S | — | — | $-C_2H_5$ | $-C_2H_5$ | $-C_2H_5$ | $I^{\ominus}$ | 1 |
| | I-2 | S | S | — | — | " | $-C_2H_5$ | $-(CH_2)_3SO_3^{\ominus}$ | — | 0 |
| | I-3 | S | S | — | — | " | $-(CH_2)_3SO_3^{\ominus}$ | $-(CH_2)_3SO_3^{\ominus}$ | $H^{\oplus}NEt_3$ | 1 |
| | I-4 | S | S | — | — | 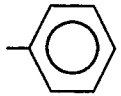 | $-C_2H_5$ | $-C_2H_5$ | $I^{\ominus}$ | 1 |
| | I-5 | S | S | — | — | " | $-C_2H_5$ | $-(CH_2)_3SO_3^{\ominus}$ | — | 0 |
| | I-6 | S | S | — | — | " | $-(CH_2)_3SO_3^{\ominus}$ | $-(CH_2)_3SO_3^{\ominus}$ | $H^{\oplus}NEt_3$ | 1 |
| 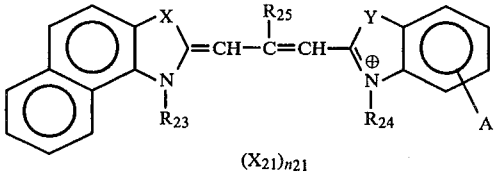 | I-7 | S | S | 5-Cl | — | $-C_2H_5$ | $-C_2H_5$ | $-(CH_2)_3SO_3^{\ominus}$ | — | 0 |
| | I-8 | S | S | 5-$OCH_3$ | — | " | $-C_2H_5$ | $-(CH_2)_3SO_3^{\ominus}$ | — | 0 |
| | I-9 | S | S | 5-$OCH_3$-6-$CH_3$ | — | " | $-C_2H_5$ | $-(CH_2)_3SO_3^{\ominus}$ | — | 0 |
| | I-10 | S | S | 5-Cl | — | 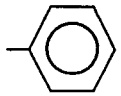 | $-C_2H_5$ | $-(CH_2)_3SO_3^{\ominus}$ | — | 0 |
| | I-11 | S | S | 5-$OCH_3$ | — | " | $-C_2H_5$ | $-(CH_2)_3SO_3^{\ominus}$ | — | 0 |
| | I-12 | S | S | 5-$OCH_3$-6-$CH_3$ | — | " | $-C_2H_5$ | $-(CH_2)_3SO_3^{\ominus}$ | — | 0 |
| 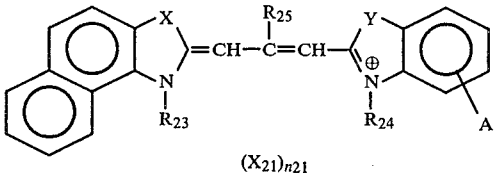 | I-13 | S | Se | — | — | $-C_2H_5$ | $-C_2H_5$ | $-C_2H_5$ | $I^{\ominus}$ | 1 |
| | I-14 | S | Se | — | — | $-C_2H_5$ | $-C_2H_5$ | $-(CH_2)_3SO_3^{\ominus}$ | — | 0 |
| | I-15 | S | Se | 5-Cl | — | $-C_2H_5$ | $-C_2H_5$ | $-C_2H_5$ | $I^{\ominus}$ | 1 |
| | I-16 | S | Se | 5-Cl | — | $-C_2H_5$ | $-C_2H_5$ | $-(CH_2)_3SO_3^{\ominus}$ | — | 0 |
| | I-17 | S | Se | 5-$CH_3$ | — | $-C_2H_5$ | $-C_2H_5$ | $-C_2H_5$ | $I^{\ominus}$ | 1 |
| | I-18 | S | Se | 5-$CH_3$ | — | $-C_2H_5$ | $-C_2H_5$ | $-(CH_2)_3SO_3^{\ominus}$ | — | 0 |
| | I-19 | S | Se | 5-$OCH_3$ | — | " | $-C_2H_5$ | $-(CH_2)_3SO_3^{\ominus}$ | — | 0 |
| | I-20 | S | Se | 5-OH | — | " | $-C_2H_5$ | $-C_2H_5$ | $I^{\ominus}$ | 1 |
| | I-21 | S | Se | 5-OH | — | " | $-C_2H_5$ | $-(CH_2)_3SO_3^{\ominus}$ | — | 0 |
| | I-22 | S | Se | 5,6-di$CH_3$ | — | " | $-C_2H_5$ | $-(CH_2)_3SO_3^{\ominus}$ | — | 0 |
| | I-23 | S | Se | 5-Cl | — | 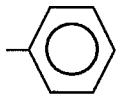 | $-C_2H_5$ | $-(CH_2)_3SO_3^{\ominus}$ | — | 0 |
| | I-24 | S | Se | 5-$OCH_3$ | — | " | $-C_2H_5$ | $-(CH_2)_3SO_3^{\ominus}$ | — | 0 |
| | I-25 | S | Se | 5-$OCH_3$-6-$CH_3$ | — | " | $-C_2H_5$ | $-(CH_2)_3SO_3^{\ominus}$ | — | 0 |
| 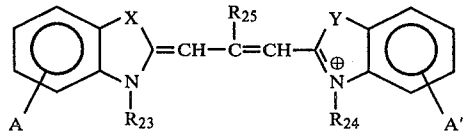 | I-26 | S | S | 5-Cl | — | 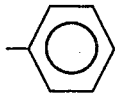 | $-(CH_2)_3SO_3^{\ominus}$ | $-(CH_2)_3SO_3^{\ominus}$ | $H^{\oplus}NEt_3$ | 1 |
| | I-27 | S | S | 5-$OCH_3$ | — | " | $-(CH_2)_3SO_3^{\ominus}$ | $-(CH_2)_3SO_3^{\ominus}$ | $H^{\oplus}NEt_3$ | 1 |
| | I-28 | S | S | 5-$OCH_3$ | 5′-$CH_3$ | " | $-(CH_2)_3SO_3^{\ominus}$ | $-(CH_2)_3SO_3^{\ominus}$ | $H^{\oplus}NEt_3$ | 1 |
| | I-29 | Se | Se | — | — | $-C_2H_5$ | $-C_2H_5$ | $-C_2H_5$ | $I^{\ominus}$ | 1 |
| | I-30 | Se | Se | 5-Cl | — | " | $-C_2H_5$ | $-C_2H_5$ | $I^{\ominus}$ | 1 |
| | I-31 | Se | Se | 5-$CH_3$ | — | " | $-C_2H_5$ | $-C_2H_5$ | $I^{\ominus}$ | 1 |
| | I-32 | Se | Se | 5-OH | — | " | $-C_2H_5$ | $-C_2H_5$ | $I^{\ominus}$ | 1 |
| | I-33 | Se | Se | 5-$OCH_3$ | — | " | $-C_2H_5$ | $-C_2H_5$ | $I^{\ominus}$ | 1 |
| | I-34 | Se | Se | 5,6-di$CH_3$ | — | " | $-C_2H_5$ | $-C_2H_5$ | $I^{\ominus}$ | 1 |

-continued

| Mother Skeleton | Compound No. | X | Y | A | A′ | $R_{25}$ | $R_{23}$ | $R_{24}$ | $X_{21}$ | $n_{21}$ |
|---|---|---|---|---|---|---|---|---|---|---|
| 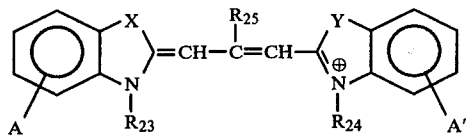 $(X_{21})_{n21}$ | I-35 | Se | Se | 5-Cl | — | $-C_2H_5$ | $-C_2H_5$ | $-(CH_2)_3SO_3^{\ominus}$ | — | 0 |
| | I-36 | Se | Se | 5-Cl | 5′-$CH_3$ | $-C_2H_5$ | $-C_2H_5$ | $-(CH_2)_3SO_3^{\ominus}$ | — | 0 |
| | I-37 | Se | Se | — | — | $-C_2H_5$ | $-(CH_2)_3SO_3^{\ominus}$ | $-(CH_2)_3SO_3^{\ominus}$ | $H^{\oplus}NEt_3$ | 1 |
| | I-38 | Se | Se | 5-C l | — | $-C_2H_5$ | $-(CH_2)_3SO_3^{\ominus}$ | $-(CH_2)_3SO_3^{\ominus}$ | $H^{\oplus}NEt_3$ | 1 |
| | I-39 | Se | Se | 5-$CH_3$ | — | $-C_2H_5$ | $-(CH_2)_3SO_3^{\ominus}$ | $-(CH_2)_3SO_3^{\ominus}$ | $H^{\oplus}NEt_3$ | 1 |
| | I-40 | Se | Se | 5-OH | — | $-C_2H_5$ | $-(CH_2)_3SO_3^{\ominus}$ | $-(CH_2)_3SO_3^{\ominus}$ | $H^{\oplus}NEt_3$ | 1 |
| | I-41 | Se | Se | 5-$OCH_3$ | — | $-C_2H_5$ | $-(CH_2)_3SO_3^{\ominus}$ | $-(CH_2)_3SO_3^{\ominus}$ | $H^{\oplus}NEt_3$ | 1 |
| | I-42 | Se | Se | 5,6-di$CH_3$ | — | $-C_2H_5$ | $-(CH_2)_3SO_3^{\ominus}$ | $-(CH_2)_3SO_3^{\ominus}$ | $H^{\oplus}NEt_3$ | 1 |
| 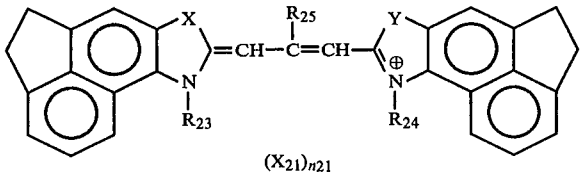 $(X_{21})_{n21}$ | I-43 | S | S | — | — | $-C_2H_5$ | $-C_2H_5$ | $-C_2H_5$ | $I^{\ominus}$ | 1 |

The amount of the compound represented by the general formula (I) depends on the composition of the silver halide emulsion but is normally in the range of $1\times10^{-6}$ to $1\times10^{-2}$ mol, preferably $1\times10^{-5}$ to $5\times10^{-3}$ mol per mol of silver halide.

Suitable silver halide emulsions which can be used in the silver halide color photographic material of the present inention comprise those of silver chloride, silver bromochloride or silver bromochloroiodide.

The silver iodide content of the silver halide emulsion is in the range of 1 mol % or less, preferably 0.2 mol % or less. The halogen composition of the emulsion may differ from grain to grain. If an emulsion having the same halogen composition from grain to grain is used, uniform grain properties can be easily achieved. The halogen composition in the silver halide emulsion grain can be appropriately selected from uniform type grains wherein the composition is uniform in any portion, lamination type grains wherein the halogen composition differs from core to shell (single layer or plural layers) and grains having a non-layered internal or surface portion differing from the other portion in terms of halogen composition (if this portion is at the surface of the grain, a portion with a different halogen composition may be fused to the edges, corners or faces of the grain). In order to obtain high sensitivity, the latter two types of grains may be advantageously used rather than uniform type of grains. These two types of grains may be advantageously used also to achieve pressure resistance. If the silver halide grain has the above described structure, the interface of the different halogen compositions may be a definite interface, an indefinite interface containing a mixed crystal formed by a composition difference, or a portion having a definitive continuous structure change.

The halogen composition of the silver bromochloride emulsion for a light-sensitive material suitable for rapid processing can be a high silver chloride emulsion having a high silver chloride content. In the present invention, the silver chloride content of such a high silver chloride emulsion is preferably 90 mol %, more preferably 95 mol % or more.

In such a high silver chloride emulsion, a silver bromide localized phase preferably is present in layers or other structures in and/or on the silver halide grains. In the halogen composition of the above described localized phase, the silver bromide content is preferably at least 10 mol %, more preferably more than 20 mol %. The localized phase may is present inside the grain or on the edges, corners or faces of the grain. In a preferred example, such a localized phase is formed on the corners of the grain by epitaxial growth.

For the purpose of minimizing a decrease in the sensitivity of the light-sensitive material under pressure, a high silver chloride emulsion having a silver chloride content of 90 mol % or more also may preferably comprise uniform grains having a small halogen composition distribution therein.

Furthermore, for the purpose of reducing the replenishment rate of the developer, a further increase in the silver chloride content of the silver halide emulsion is effective. In this case, a substantially pure silver chloride emulsion having a silver chloride content of 98 to 100 mol % may be preferably used.

The average grain size (number average of the diameter of circles equivalent to the projected area of grains) of silver halide grains contained in the silver halide emulsion to be used in the present invention is preferably in the range of 0.1 to 2 $\mu$m.

The grain size distribution is preferably monodisperse such that the fluctuation coefficient thereof (obtained by dividing the standard deviation of the grain size distribution by the average grain size) is 20% or less, preferably 15% or less. For the purpose of obtaining a wide tolerance, a blend of these monodisperse emulsions may be preferably incorporated in the same layer or these monodisperse emulsions may preferably be separately coated in layers.

The silver halide grains to be incorporated in the photographic emulsion may have a regular crystal form such as a cube, a tetradecahedron and an octahedron, an irregular crystal form such as a sphere and a tablet or a composite thereof. Alternatively, the silver halide grains may comprise a mixture of grains having various crystal forms. In the present invention, the silver halide grains preferably comprise grains having the above described regular crystal form in a proportion of 50% or more, preferably 70% or more, more preferably 90% or more.

Moreover, an emulsion wherein tabular grains having an aspect ratio (diameter as calculated in terms of circle/thickness) of 5 or more, preferably 8 or more account for more than 50% of all of the grains, calculated in terms of projected area, may also be preferably used.

The preparation of the silver bromide emulsion which can be used in the present invention can be accomplished by any suitable method as described in P. Glafkides, *Chimie et Physique Photographique*, Paul Montel (1967), G. F. Duffin, *Photographic Emulsion Chemistry,* Focal Press, 1966, and V. L. Zelikman et al., *Making and Coating Photographic Emulsion*, Focal Press, 1964. In some detail, the emulsion can be prepared by any of the acid process, the neutral process, the ammonia process, etc. The reaction between a soluble silver salt and a soluble halogen salt can be carried out using a single jet process, a double jet process, a combination thereof, and the like. A method in which grains are formed in the presence of excess silver ions (the so-called reverse mixing method) may be used. Further, a so-called controlled double jet process, in which the pAg value of the liquid phase in which silver halide grains are formed is maintained constant, may also be used. According to the controlled double jet process, a silver halide emulsion having a regular crystal form and a substantially uniform grain size can be obtained.

During the formation or the physical ripening of the silver halide emulsion grains, various multivalent metal ion impurities can be incorporated in the system.

Preferred silver halide grains used in the present invention should comprise silver bromochloride substantially free of silver iodide wherein 95 mol % or more of all the silver halides of the silver halide grains is silver chloride. The term "substantially free of silver iodide" as used herein means "containing silver iodide in an amount of 1.0 mol % or less." The preferred halogen composition of the silver halide grains is a silver bromochloride substantially free of silver iodide wherein 98 mol % or more of all the silver halides of the silver halide grains is silver chloride.

The preferred silver halide grains of the present invention preferably comprise a localized phase with a silver bromide content of at least 10 mol %. This localized phase with a high silver bromide content needs to be in the vicinity of the surface of the grains in order to accomplish the effects of the present invention and from the standpoint of pressure resistance and dependence on composition of processing solution. The term "in the vicinity of the surface of the grains" as used herein means "being within one-fifth of the size of the silver halide grains used from the surface thereof." It is preferably within one-tenth of the size of the silver halide grains used. This localized phase with a high silver bromide content is one with a silver bromide content of at least 10 mol % which has been epitaxially grown, most preferably at the apex of cubic or tetradecahedral silver chloride grains or in its vicinity.

The localized phase with a high silver bromide content preferably has a silver halide content of more than 10 mol %. However, if the silver bromide content is too high, the light-sensitive material have undesirable properties such as desensitization under pressure and great change in sensitivity and gradation due to variation in the composition of the processing solution. Thus, the silver bromide content of the localized phase is preferably in the range of 10 to 60 mol %, particularly 20 to 50 mol %. The silver bromide content of the localized phase can be determined by X-ray diffractometry as described in Kozo Kaiseki (*Structural Analysis)-Shinikken Kagaku Kozo* 6, Nihon Kagakukai, Maruzen. The localized phase with a high silver bromide content preferably comprises 0.1 to 20%, more preferably 0.2 to 8%, of the total weight of silver of the silver halide grains used in the present invention.

The localized phase with a high silver bromide content and the other phase may have a definite interface therebetween or a transition zone in which the halogen composition gradually changes therebetween.

The formation of the localized phase with a high silver bromide content can be accomplished in a stable manner using a process which comprises supplying bromine ions to the host silver halide grains so that an exchange reaction with halogen ions on the surface of the host silver halide grains occurs (the so-called halogen conversion) or a process which comprises mixing finely divided silver halide grains having a smaller average grain diameter and a higher silver bromide content than the host silver halide grains with the host silver halide grains so that a recrystallization reaction occurs.

The metallic ions to be incorporated in the silver halide grains of the present invention are one or more selected from the group consisting of metallic ions of group VIII metals such as iron, iridium, platinum, palladium, nickel, rhodium, osminium, ruthenium and cobalt, group II transition metals such as cadmium, zinc and mercury, lead, copper, and thallium. Ions of transition metals such as iron, iridium, platinum, palladium, nickel and rhodium are particularly preferred. Specific examples of compounds containing these metallic ions are set forth below, but the present invention is not to be construed as being limited thereto.

Specific examples include ferrous arsenate, ferrous bromide, ferrous carbonate, ferrous chloride, ferrous citrate, ferrous fluoride, ferrous formate, ferrous gluconate, ferrous hydroxide, ferrous iodide, ferrous lactate, ferrous oxalate, ferrous phosphate, ferrous succinate, ferrous sulfate, ferrous thiocyanate, ferrous nitrate, ferrous ammonium nitrate, basic ferric acetate, ferric albuminate, ferric ammonium acetate, ferric bromide, ferric chloride, ferric chromate, ferric citrate, ferric fluoride, ferric formate, ferric glycerophsphate, ferric hydroxide, acidic ferric phosphate, ferric nitrate, ferric phosphate, ferric pyrrophosphate, ferric sodium pyrrophosphate, ferric thiocyanate, ferric sulfate, ferric ammonium sulfate, ferric guanidine sulfate, ferric ammonium citrate, potassium hexacyanoferrate (II), ferric potassium pentacyanoammine, ferric sodium ethylenedinitrilotetraacetate, potassium hexacyanoferrate (III), chlorinated ferric tris(dipyridyl), ferric potassium pentacyanonitrosil, chlorinated ferric hexaurea, iridous chloride (III), iridous bromide (III), iridic chloride (IV), sodium hexachloroiridiumate (III), potassium hexachloroiridiumate (IV), hexammineiridiumate (III), hexammineiridiumate (IV), trioxalatiridiumate (III), trioxalatiridiumate (IV), platinum chloride (IV), potassium hexachloroplatinumate (IV), tetrachloroplatinic acid (II), tetrabromoplatinumic acid (II), sodium tetrakis(thiocyanate )platinumate (VI), hexammineplatinum (IV) chloride, sodium tetrachloropalladiumate (II), sodium tetrachloropalladiumate (IV), potassium hexachloropalladiumate (IV), tetramminepalladium (II) chloride, potassium tetracyanopalladiumate (II), nickel chloride, nickel bromide, potassium tetrachloronickelate (II), hexamminenickel (II) chloride, sodium tetracyanonickelate (II), potassium hexachlorodiumate, sodium hexabromodiumate and ammonium hexachlorodiumate.

In order to incorporate the metallic ions in the localized phase and/or the other portion (substrate) of the silver halide grains, the metallic ions are preferably incorporated in the emulsion before or during the formation of the grains or during the physical ripening of the grains. For example, the metallic ions may be incorporated in an aqueous solution of gelatin, of a halide, of a silver salt or the like to form silver halide grains.

The metallic ions in the silver bromide localized phase on the surface of silver chloride grains can be incorporated by a process which comprises supplying the metallic ions with silver bromide ions, for example, adding metallic ions into an aqueous solution of halides or supplying an aqueous solution of metallic ions and an aqueous solution of halide. This can also be effectively accomplished by a process which comprises incorporating metallic ions in finely divided silver halide grains, and then mixing the grains with a desired host silver halide emulsion to effect recrystallization.

Iron ion, platinum ion, palladium ion and rhodium ion are preferably incorporated in the surface portion of silver halide grains. Iridium ion is preferably incorporated in the silver halide localized phase.

The amount of the metallic ions present is preferably in the range of $10^{-9}$ to $10^{-2}$ mol, more preferably $10^{-8}$ to $10^{-3}$ tool.

The average grain size (number average of grain sizes calculated in terms of the diameter of a circle equivalent to the projected area of a grain) of the silver halide grains present in the silver halide emulsion to be used in the present invention is preferably in the range of 0.1 to 2 $\mu$m.

The grain size distribution may be monodisperse such that the coefficient of variation (obtained by dividing the standard deviation of the grain size distribution by the average grain size) is in the range of 20% or less, preferably 15% or less. In order to obtain a wide tolerance, the above described monodisperse emulsion may be advantageously blended in the same layer or coated in a multiplicity of layers.

The total weight of silver halide emulsions incorporated in the color photographic light-sensitive material of the present invention is preferably in the range of 0.78 g/m$^2$ or less, more preferably 0.65 g/m$^2$less, calculated in terms of silver. The total weight of silver halide emulsions incorporated in the cyan dye image forming layer is preferably in the range of 0.25 g/m$^2$ or less, more preferably 0.21 g/m$^2$ or less, calculated in terms of silver.

The optical reflection density of the light-sensitive material of the present invention is determined by means of a reflection densitometer conventionally used in the art and defined as follows: a reflective plate is provided on the back side of the sample to eliminate errors in measurements due to the passage of light through the specimen.

$$\text{Optical reflection density} = \log_{10}(F_0/F)$$

wherein $F_0$: light flux reflected by standard white plate;

F: light flux reflected by sample

In the present invention, the density used in combination with the above defined coated amount, calculated in terms of silver, is 0.50 or more at a measured wavelength range of 680 nm. If this value is less than 0.50, there is little improvement in sharpness. This value is preferably in the range of 0.5 to 2.0. If this value is more than 2.0, a remakable amount of color remaining exists after processing. This value is more preferably in the range of 0.5 to 1.5.

In order to obtain the optical reflection density defined by the present invention, the amount of dyes employed is controlled. These dyes may be used alone or in combination. Layers in which these dyes are incorporated are not specifically limited. For example, these dyes may be incorporated in the layer between the lowermost layer and the light-sensitive layer, the light-sensitive layer, the interlayer, the protective layer, the protective layer, the layer between the protective layer and the uppermost light-sensitive layer, etc.

The dyes to be used for this purpose can be selected from those which do not substantially spectrally sensitize silver halide.

The incorporation of these dyes in the system can be accomplished by any commonly used methods. For example, these dyes may be incorporated in the system in the form of aqueous solution or a solution in an alcohol, such as methanol.

The dyes incorporated in the above mentioned layers may be diffuse dyes which in all the layers or dyes fixed in specific layers between coating and drying of the light-sensitive material.

Various dyes such as oxonol dyes containing a pyrazolone nucleus or a barbituric acid nucleus, azo dyes, azomethine dyes, anthraquinone dyes, arylidene dyes, styryl dyes, triarylmethane dyes, melocyanine dyes and cyanine dyes can be used for the objects of the present invention.

Among these dyes, those which are particularly preferably used in the present invention are compounds as disclosed in European Patent EP 0 337 490, pp. 9 to 71 (particularly oxonol dyes).

In order to improve the image sharpness, the light-sensitive material of the present invention may preferably include titanium oxide surface-treated with an alcohol having a valency of 2 to 4 (e.g., trimethylol ethane) in the water-resistant resin layer in the support in an amount of 12% by weight or more (more preferably 14% by weight or more).

The silver halide emulsion to be used in the present invention is normally subjected to chemical or spectral sensitization.

Chemical sensitization can be accomplished by sulfur sensitization with, e.g., an unstable sulfur compound, noble metal sensitization such as gold sensitization, and reduction sensitization, alone or in combination. Compounds to be used in chemical sensitization there are preferably those described JP-A-62-215272, lower right column on page 18 - upper right column on page 22.

Examples of compounds which can be used for sulfur sensitization include thiosulfates, rhodanines, thioureas, thioamides (e.g., compounds as described in U.S. Pat. Nos. 2,410,689, 3,501,313, 2,278,947, 1,574,944, 2,728,668, 3,656,955, 4,001,025, and 4,116,697, and JP-A-55-45016), thioesters (e.g., compounds as described in JP-B-43-13485, JP-B-55-42374, and British Patent 1,190,678), and polysulfur compounds (e.g., compounds as described in U.S. Pat. Nos. 3,647,469, 3,656,955, and 3,689,273, JP-A-53-81230, and JP-B-49-20533 and JP-B-59-45134). Sulfur sensitizing compoud is generally used in an amount of $10^{-7}$ to $10^{-2}$ mol per mol of silver halide.

Compounds to be used for selenium sensitization include the selenium compounds as described in JP-A-60-150046.

Gold compounds to be used for gold sensitization include various compounds with an oxidation number of 1 or 3. Typical examples of such gold compounds include complex ions or complex salts such as tetrachloroauric (III) acid, tetracyanoauric (III) acid, tetrakis(thiocyanate )auric (III) acid, alkaline metal salts thereof, bis(thiosulfite)auric (I) acid and chlorinated dimethylodanateauric (I) acid.

The amount of such a gold compound used can be selected from a wide range and is normally in the range of $1\times10^{-7}$ to $1\times10^{-2}$ mol, preferably $1\times10^{-8}$ to $1\times10^{-3}$ mol, more preferably $2\times10^{-8}$ to $1\times10^{-4}$ mol per mol of silver halide.

Examples of compounds which can be used for reduction sensitization include inorganic reducing agents such as $SnCl_2$ and $NaBH_4$, amines, hydrazines, formamidinesulfinic acids, silane compounds (e.g., compounds as described in U.S. Pat. Nos. 2,518,698, 2,743,182, 3,369,904, 2,666,700, 2,419,973, 2,419,974, 2,419,975, 2,740,713, 2,521,926, 2,487,850, 2,983,609, 2,983,610, 2,694,637, 3,930,867, and 3,904,415, British patent 1,390,540 and JP-A-50-127622 and JP-A-57-163232), and aldehydes (e.g., compounds as described in U.S. Pat. No. 2,604,397). Reduction sensitizing compound is generally used in an amount of $10^{-8}$ to $10^{-3}$ mol per mol of silver halide.

Examples of compounds which can be used for noble metal sensitization include gold compounds as defined in the present invention, and complex compounds of group VIII transition elements such as platinum, iridium and palladium (e.g., compounds as described in U.S. Pat. Nos. 2,399,083, 2,448,060, 3,503,749, 2,597,856, 2,597,915, 2,624,674, and 2,642,361, and British Patent 618,061). Noble metal for sensitization is generally used in an amount of $10^{-7}$ to $10^{-2}$ mol per mol of silver halide.

Spectral sensitization provides the emulsion in each layer in the light-sensitive material of the present invention with a spectral sensitivity in the desired light wavelength range. In the present invention, this spectral sensitization is preferably carried out by incorporating a dye which absorbs light having a wavelength range corresponding to the desired spectral sensitivity, i.e., spectral sensitizing dye. Examples of suitable spectral sensitizing dyes include those described in F. M. Harmer, *Heterocyclic Compounds-Cyanine Dyes and Related Compounds*, John Wiley & Sons (New York, London), 1964. Specific examples of such compounds and spectral sensitizing processes which can be advantageously used in the present invention are described in JP-A-62-215272, upper right column on page 22–page 38.

For the purpose of inhibiting fogging during preparation, storage or photographic processing of the light-sensitive material or stabilizing the photographic properties of the light-sensitive material, various compounds or precursors thereof can be incorporated in the silver halide emulsion. Specific examples of such compounds which can be advantageously used in the present invention are described in the above cited JP-A-62-215272, pp. 39–72.

The emulsion to be used in the present invention may be either a so-called surface latent image type in which latent images are formed mainly on the surface of grains or a so-called inner latent image type in which latent images are formed mainly inside the grains.

In the present invention, the color light-sensitive material normally includes yellow, magenta and cyan couplers which undergo coupling reaction with an oxidation product of an aromatic amine developing agent to form a yellow color, a magenta color and a cyan color, respectively.

The cyan couplers which can be advantageously used in the present invention are represented by the general formulae (C-I), (C-II), (M-I), (M-II) and (Y):

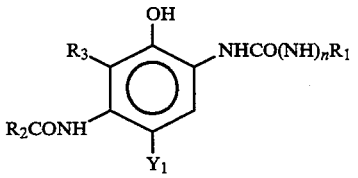

(C-I)

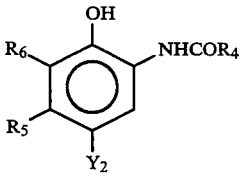

(C-II)

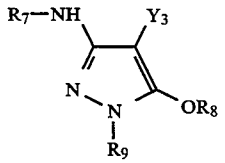

(M-I)

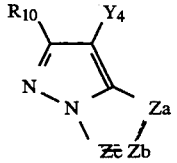

(M-II)

-continued

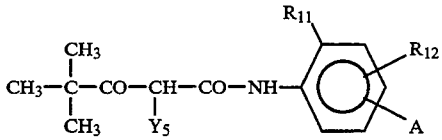

(Y)

In the general formulae (C-I) and (C-II), $R_1$, $R_2$ and $R_4$ each represents a substituted or unsubstituted aliphatic, aromatic or heterocyclic group. $R_3$, $R_5$ and $R_6$ each represents a hydrogen atom, a halogen atom, an liphatic group, an aromatic group or an acylamino group. $R_3$ may represent an atomic group which forms a 5- or 6-membered nitrogen-containing ring with $R_2$. $Y_1$ and $Y_2$ each represents a hydrogen atom or a group releasable upon coupling with an oxidation product of a developing agent. The subscript n represents an integer 0 or 1.

In the general formula (C-II), $R_5$ is preferably an aliphatic group. Examples of such an aliphatic group include methyl, ethyl, propyl, butyl, pentadecyl, tert-butyl, cyclohexyl, cyclohexylmethyl, phenylthiomethyl, dodecyloxyphenylthiomethyl, butanamidomethyl, and methoxymethyl.

Preferred examples of cyan couplers represented by the general formula (C-I) or (C-II) are set forth below.

In the general formula (C-I), $R_1$ is preferably an aryl group or a heterocyclic group, more preferably, an aryl group substituted with a halogen atom, an alkyl group, an alkoxy group, an aryloxy group, an acylamino group, an acyl group, a carbamoyl group, a sulfonamide group, a sulfamoyl group, a sulfonyl group, a sulfamide group, an oxycarbonyl group or a cyano group.

In the general formula (C-I), if $R_3$ and $R_2$ do not combine and form a ring, $R_2$ is preferably a substituted or unsubstituted alkyl or a substituted or unsubstituted aryl group, particularly, a substituted aryloxy-substituted alkyl group, and $R_3$ is preferably a hydrogen atom.

In the general formula (C-II), $R_4$ is preferably a substituted or unsubstituted alkyl or aryl group, particularly a substituted aryloxy-substituted alkyl group.

In the general formula (C-II), $R_5$ is preferably a $C_{2-15}$ alkyl group or a methyl group containing a substituent with one or more carbon atoms. Preferred examples of suitable substituents include an arylthio group, an alkylthio group, an acylamino group, an aryloxy group, and an alkyloxy group.

In the general formula (C-II), $R_5$ is more preferably a $C_{2-15}$ alkyl group, particularly, a $C_{2-4}$alkyl group.

In the general formula (C-II), $R_6$ is preferably a hydrogen atom or a halogen atom, particularly a chlorine atom or a fluorine atom. In the general formulae (C-I) and (C-II), $Y_1$ and $Y_2$ are each preferably a hydrogen atom, a halogen atom, an alkoxy group, an aryloxy group, an acyloxy group or a sulfonamide group.

In the general formula (M-I), $R_7$ and $R_9$ each represents an aryl group. $R_8$ represents a hydrogen atom, an aliphatic or aromatic acyl group or an aliphatic or aromatic sulfonyl group. $Y_3$ represents a hydrogen atom or a releasable group. The substituent which can be present on the aryl group (preferably, a phenyl group) represented by $R_7$ or $R_9$ is the same as the substituents which can be present in $R_1$. If two or more substituents are present, they may be the same or different. $R_8$ is preferably a hydrogen atom or an aliphatic acyl or sulfonyl group, particularly a hydrogen atom. The releasable group represented by $Y_3$ is preferably of the type which is released by the sulfur, oxygen or nitrogen atom. For example, a sulfur atom-releasable group as described in U.S. Pat. No. 4,351,897 and International Patent Disclosure WP-A-88-04795 is particularly preferred.

In the general formula (M-II), $R_{10}$ represents a hydrogen atom or a substituent. $Y_4$ represents hydrogen atom or a separatable group, particularly preferably a halogen atom or an arylthio group. Za, Zb and Zc each represents methine, substituted methine, =N— or —NH—. One of the Za-Zb bond and the Zb-Zc bond is a double bond and the other is a single bond. If the Zb-Zc bond is a carbon-carbon double bond, it may be part of an aromatic ring. If $R_{10}$ or $Y_4$ forms a dimer or higher polymer, or if Za, Zb or Zc is a substituted methine group, the substituted methine group may form a dimer or higher polymer.

Preferred among pyrazoloazole couplers represented by the general formula (M-II) are imidazo[1,2-b]pyrazoles as described in U.S. Pat. No. 4,500,630 because dyes developed therefrom exhibit little subsidiary absorption of yellow and have excellent fastness to light. Pyrazolo[1,5-b][1,2,4]triazoles as described in U.S. Pat No. 4,540,654 are particularly preferred.

Other preferred examples of pyrazoloazole couplers include pyrazolotriazole couplers comprising a branched alkyl group directly connected to the 2-, 3- or 6-position of the pyrazolotriazole ring as described in JP-A-61-65245, pyrazoloazole couplers containing sulfonamide groups in the molecule as described in JP-A-61-65246, pyrazoloazole couplers containing alkoxyphenylsulfonamide ballast groups as described in JP-A-61-147254, and pyrazolotriazole couplers containing an alkoxy group or an aryloxy group in the 6-position as described in European Patents (Disclosure) 226,849 and 294,785.

In the general formula (Y), $R_{11}$ represents a halogen atom, an alkoxy group, a trifluoromethyl group or an aryl group. $R_{12}$ represents a hydrogen atom, a halogen atom or an alkoxy group. A represents —$NHCOR_{13}$, —$NHSO_2$—$R_{13}$, —$SO_2NHR_{13}$, —$COOR_{13}$ or $$-SO_2\underset{\underset{R_{14}}{|}}{N}-R_{13}$$

in which $R_{13}$ and $R_{14}$ each represents an alkyl group, an aryl group or an acyl group. $Y_5$ represents a releasable group. The substituents present in $R_{12}$, $R_{13}$ and $R_{14}$ are the same as present in $R_1$. The releasable group $Y_5$ is preferably ably of the type which can be released by an oxygen atom or a nitrogen atom, particularly of a nitrogen-releasable type.

Specific examples of couplers represented by the general formulae (C-I), (C-II), (M-I), (M-II) and (Y) which can be used in the present invention are set forth below:

(C-1)

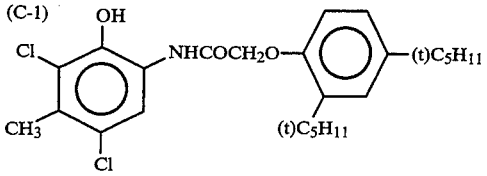

(C-2)

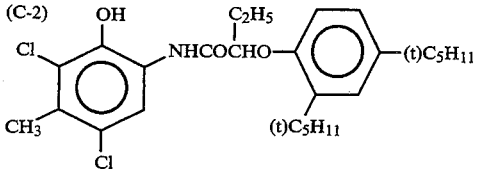

(C-3)

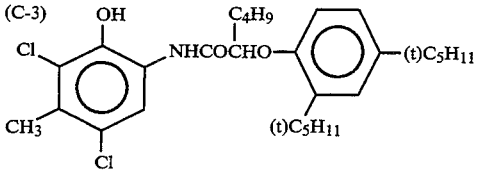

(C-4)

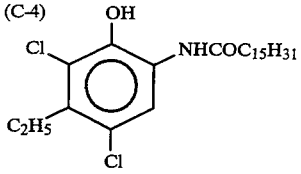

-continued
(C-5)
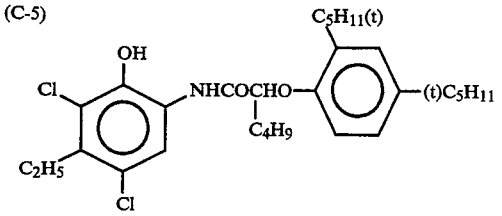
(C-6)
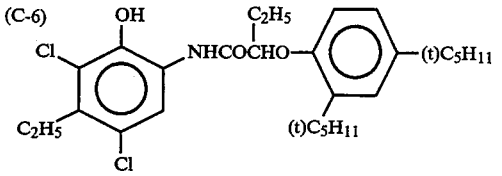
(C-7)
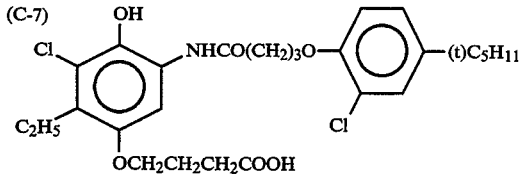
(C-8)
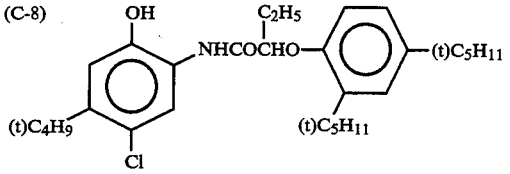
(C-9)
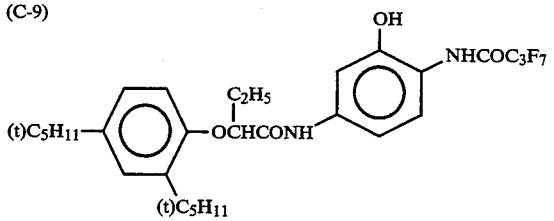
(C-10)
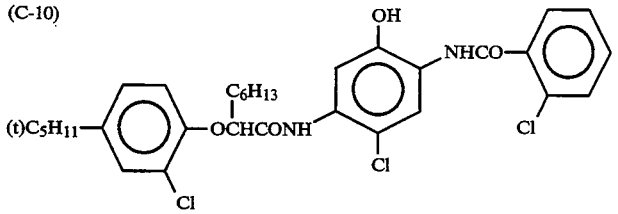
(C-11)
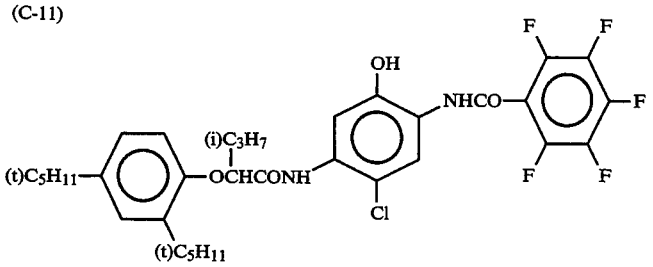

-continued
(C-12)
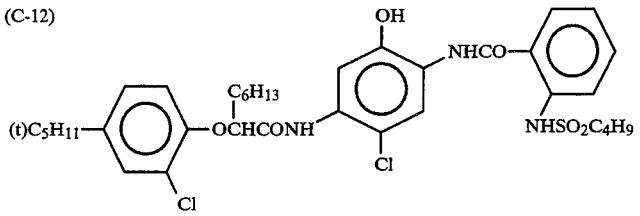
(C-13)
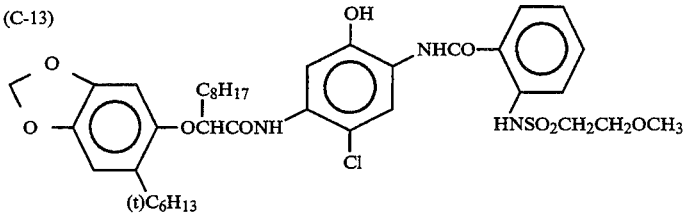
(C-14)
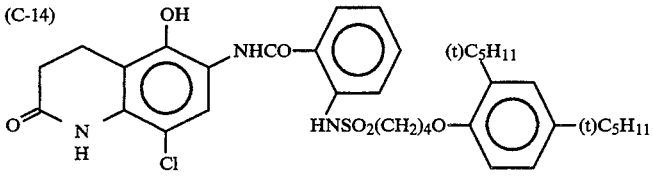
(C-15)
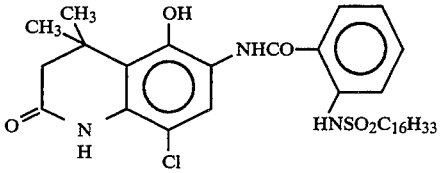
(C-16)
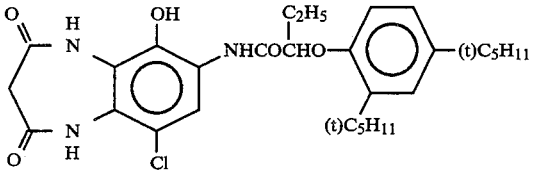
(C-17)
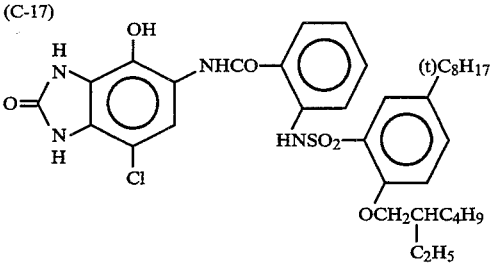
(C-18)
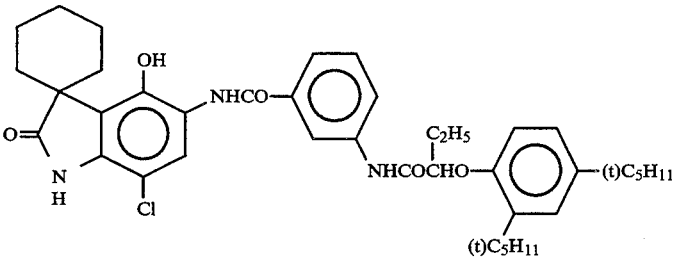

-continued
(C-19)
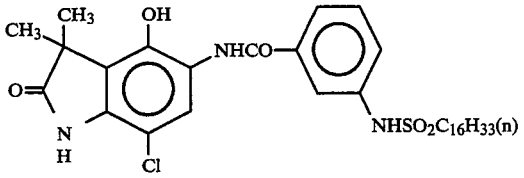
(C-20)
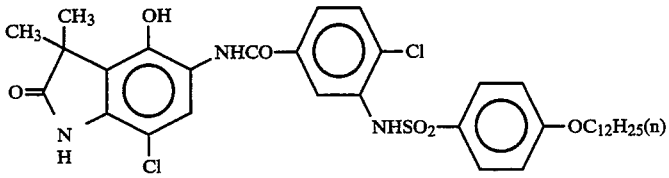
(C-21)
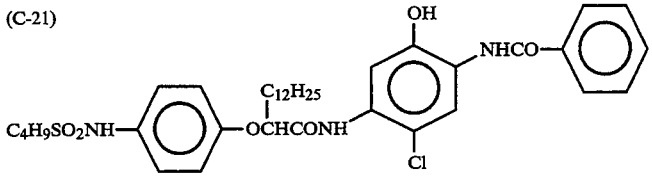
(C-22)
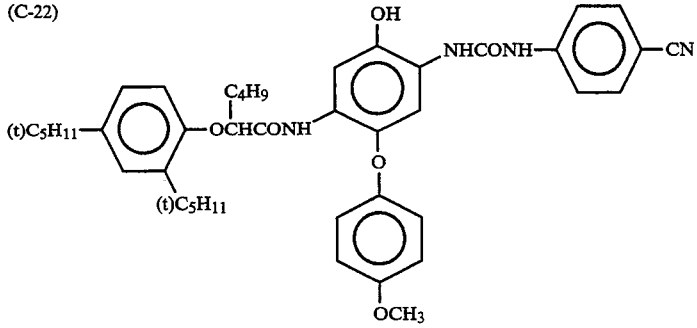
(M-1)
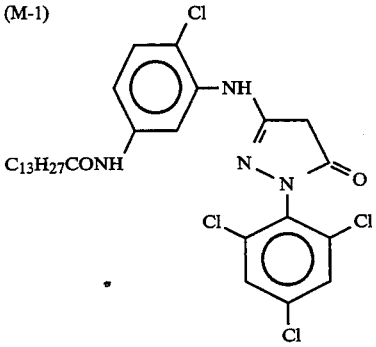
(M-2)
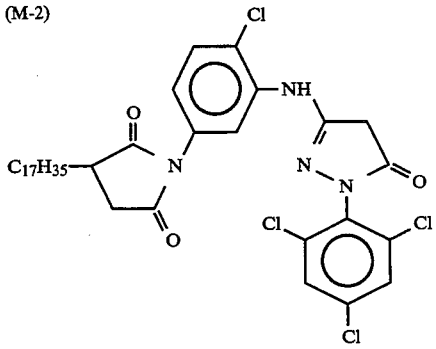

-continued
(M-3)
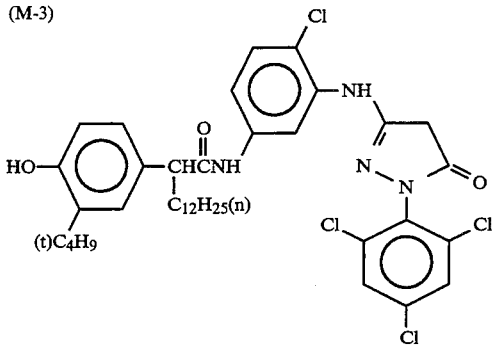
(M-4)
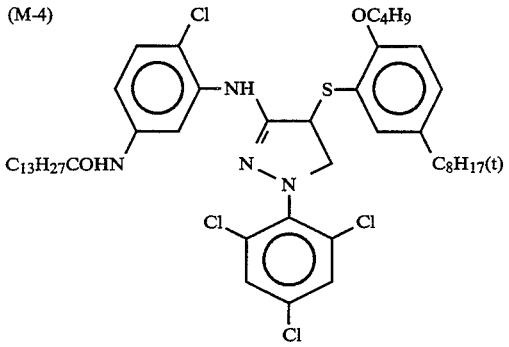
(M-5)
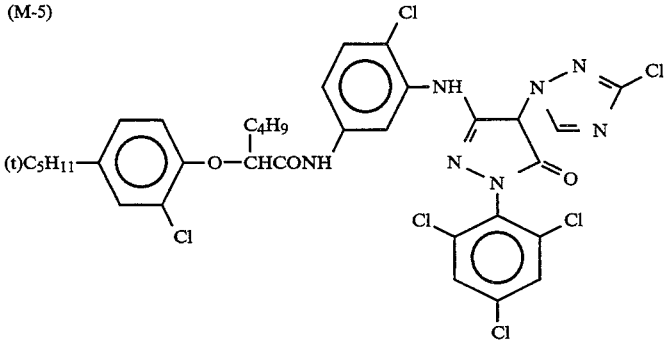
(M-6)
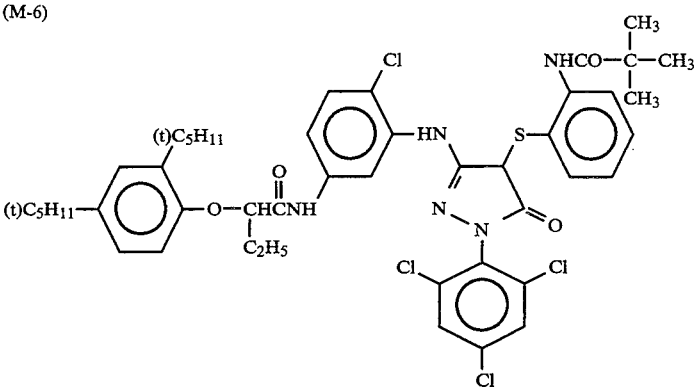

-continued
(M-7)
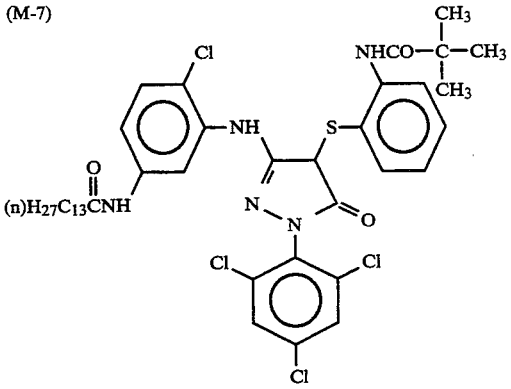
(M-8)
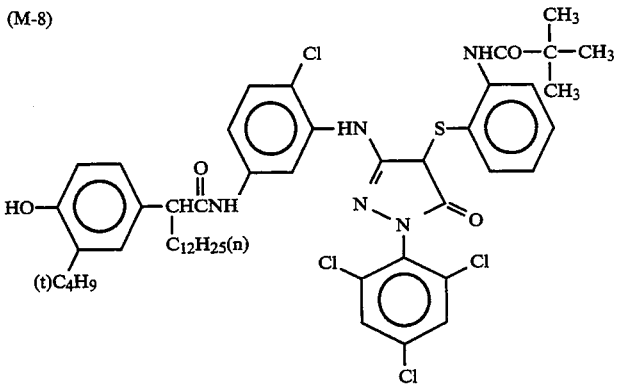
| Compound | $R_{10}$ | $R_{15}$ | $Y_4$ |
|---|---|---|---|
| | | 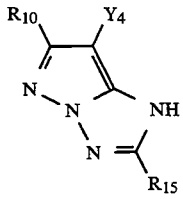 | |
| M-9 | $CH_3$— | 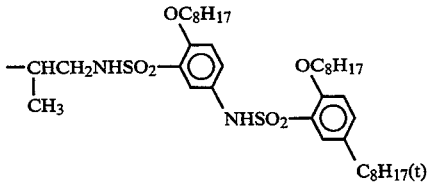 | Cl |
| M-10 | " | 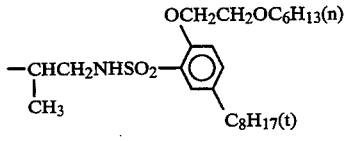 | " |
| M-11 | $(CH_3)_3C$— | 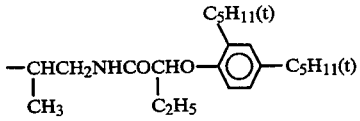 | 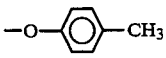 |
| M-12 | 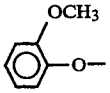 | 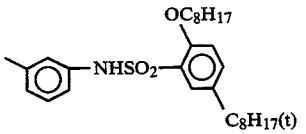 | 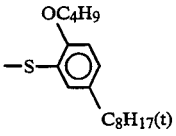 |

-continued
| | | | |
|---|---|---|---|
| M-13 | $CH_3$— | 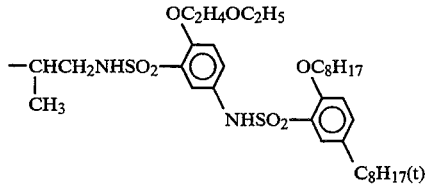 | Cl |
| M-14 | " | 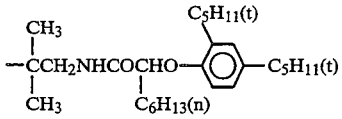 | " |
| M-15 | $CH_3$— | 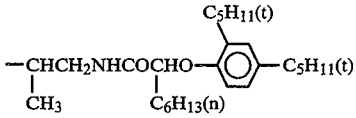 | Cl |
| M-16 | " | 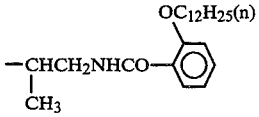 | " |
| M-17 | " | 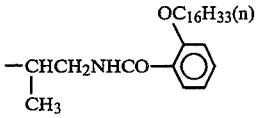 | " |
| M-18 | 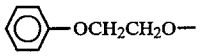 | 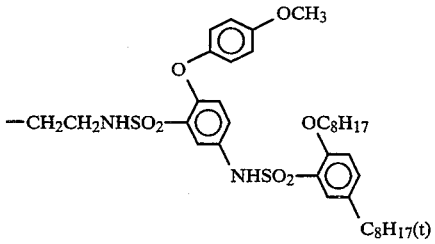 | 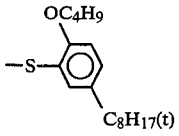 |
| M-19 | $CH_3CH_2O$— | " | " |
| M-20 | 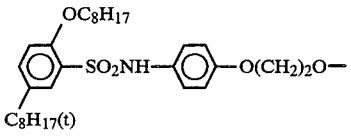 | 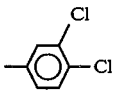 | 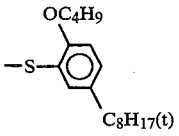 |
| M-21 | 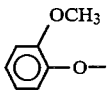 | 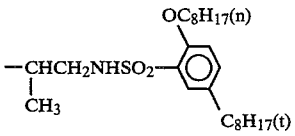 | Cl |
| | | 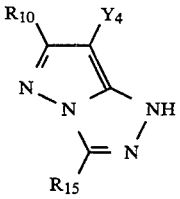 | |
| M-22 | $CH_3$— | 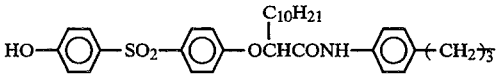 | Cl |

-continued

| | | | |
|---|---|---|---|
| M-23 | " | $(n)C_6H_{13}$ <br> $CHCH_2SO_2(CH_2)_2$ <br> $(n)C_8H_{17}$ | " |
| M-24 | $CH_3$ <br> $CH-$ <br> $CH_3$ | $OC_4H_9$ <br> $SO_2(CH_2)_3$ <br> $C_8H_{17}(t)$ | " |
| M-25 | $(CH-CH_2)_{50}(CH_2-C)_{50}$ <br> $COOCH_2CH_2OCH_3$ $CH_3$ $CONH-$ | $CH_3-CH-$ <br> $CH_2NHSO_2CH_3$ | " |
| M-26 | $O-$ | $OC_8H_{17}$ <br> $(CH_2)_2NHSO_2-$ <br> $C_8H_{17}(t)$ | Cl |
| M-27 | $CH_3-$ | $CH_3$ <br> $CH_3$ <br> $CH_3$ $NHCOCHO-$ $SO_2-$ $OCH_2-$ <br> $(n)C_{10}H_{21}$ | " |
| M-28 | $(CH_3)_3C-$ | $CH_3$ <br> $CH_3$ $C_5H_{11}(t)$ <br> $CH_3$ $NHCOCHO-$ $C_5H_{11}(t)$ <br> $C_4H_9(n)$ | " |
| M-29 | $OCH_3$ <br> $OCH_3$ | $(CH_2)_3O-$ $C_5H_{11}(t)$ <br> $C_5H_{11}(t)$ | Cl |
| M-30 | $CH_3-$ | $(n)C_{18}H_{37}$ <br> $-CH-NCOCH_2CH_2COOH$ <br> $C_2H_5$ | " |

(Y-1)

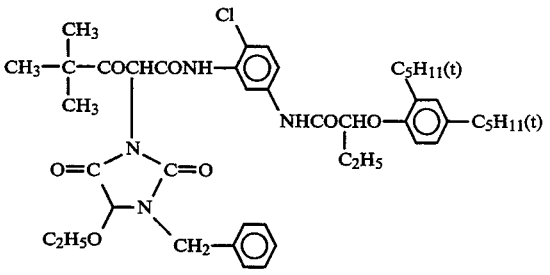

(Y-2)

-continued
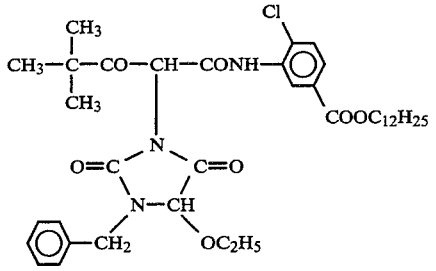
(Y-3)
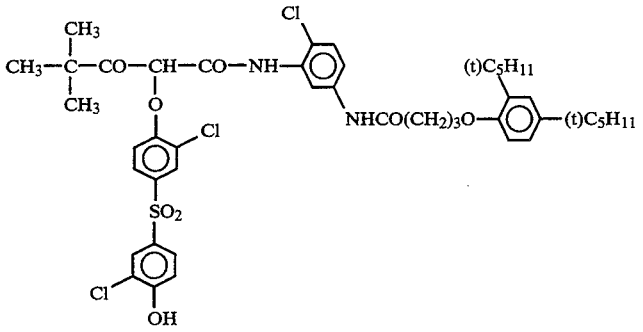
(Y-4)
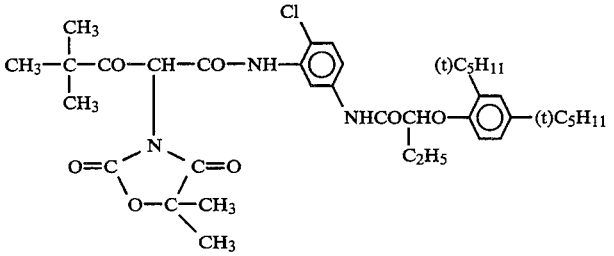
(Y-5)
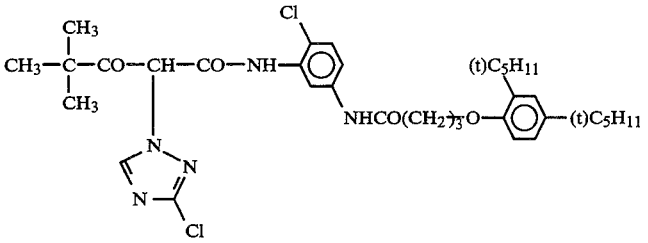
(Y-6)
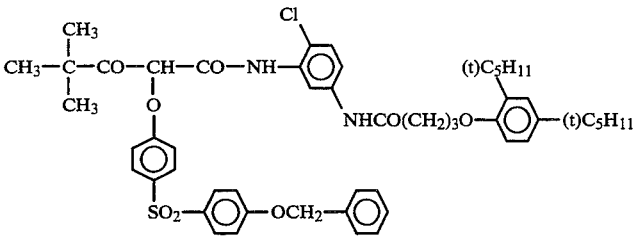
(Y-7)

-continued

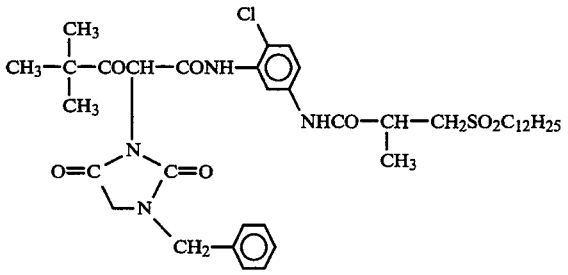

(Y-8)

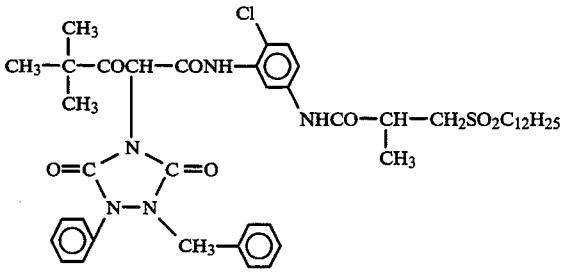

(Y-9)

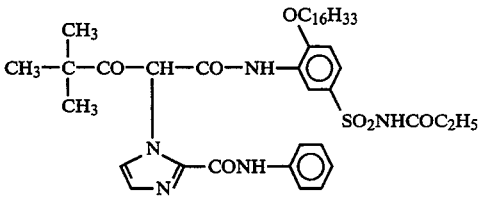

The couplers represented by the general formula (C-I) to (Y) each may be present in the silver halide emulsion layers of the light-sensitive layer in an amount of 0.1 to 1.0 mol, preferably 0.1 to 0.5 mol per mol of silver halide.

Various known methods can be used in the present invention, in order to incorporate the above mentioned couplers into the light-sensitive layer. In general, a known oil-in-water dispersion process can be used as an oil protect process to incorporate these color couplers in the light-sensitive layer. In particular, these color couplers may be emulsion-dispersed in an aqueous solution of gelatin in the form of solution in a solvent. Alternatively, water or an aqueous solution of gelatin may be added to a solution of the color coupler containing a surface active agent to cause phase inversion to occur so that an oil-in-water dispersion is prepared. An alkali-soluble coupler can be dispersed using the so-called Fischer's dispersion process. A low boiling organic solvent may be removed from the coupler dispersion by distillation, noodle washing or ultra-filtration, and then the dispersion may be mixed with a photographic emulsion.

A high boiling organic solvent and/or water-insoluble high molecular weight compound having a dielectric constant (at 25° C.) of 2 to 20 and a refractive index (at 25° C.) of 1.5 to 1.7 may be preferably used as a dispersant for such a coupler.

Examples of high boiling organic solvents which can be advantageously used include high boiling organic solvents represented by one of the general formulae (A) to (E):

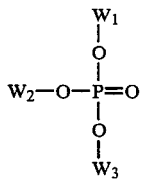

(A)

$W_1-COO-W_2$ (B)

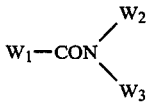

(C)

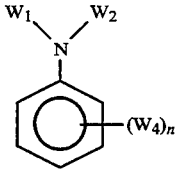

(D)

$W_1-O-W_2$ (E)

wherein $W_1$, $W_2$ and $W_3$ each represents a substituted or unsubstituted alkyl group, cycloalkyl group, alkenyl group, aryl group or heterocyclic group; $W_4$ represents $W_1$, $OW_1$ or S-$W_1$; and n represents an integer 1 to 5. When n is 2 or more, the plurality of $W_4$'s may be the same or different. In the general formula (E), $W_1$ and $W_2$ may together form a condensed ring.

Examples of high boiling organic solvent which can be used in the present invention other than those represented by the general formula (A) to (E) include any compound having a melting point of 100° C. or lower and a boiling point of 140° C. or higher which is miscible with water and can dissolve these couplers therein. The melting point of such a high boiling organic solvent is preferably 80° C. or lower. The boiling point of the high boiling organic solvent is preferably 160° C. or higher, more preferably 170° C. or higher.

These high boiling organic solvents are further described in JP-A-62-215272, lower right column on page 137–upper right column on page 144.

Furthermore, these couplers can be emulsion-dispersed in an aqueous solution of a hydrophilic colloid impregnated in a loadable latex polymer (as described in U.S. Pat. No. 4,203,716) or as a solution in a water-insoluble and organic solvent-soluble polymer in the presence or absence of the above described high boiling organic solvent.

Preferably, homopolymers or copolymers as disclosed in International Patent Disclosure WP-A-88-00723, pp. 12–30 may be used. In particular, methacrylate or acrylamide polymers may be preferably used from the standpoint of dye image stability.

The light-sensitive material prepared according to the present invention may include a hydroquinone derivative, an aminophenol derivative, a gallic acid derivative, an ascorbic acid derivative or the like as a color fogging inhibitor.

The light-sensitive material of the present invention can comprise various discoloration inhibitors. Specific examples of suitable organic discoloration inhibitors are described in the following patents.

Examples of hydroquinones are described in U.S. Pat. Nos. 2,360,290, 2,418,613, 2,700,453, 2,701,197, 2,728,659, 2,732,300, 2,735,765, 3,982,944, 4,430,425, 2,710,801, and 2,816,028, and British Patent 1,363,921. Examples of 6-hydroxychromans, 5-hydroxycoumarans, and spirocoumarans are described in U.S. Pat. Nos. 3,432,300, 3,573,050, 3,574,627, 3,698,909, and 3,764,337, and JP-A-52-15225. Examples of spiroindanes are described in U.S. Pat. No. 4,360,589. Examples of p-alkoxyphenols are described in U.S. Pat. No. 2,735,765, British Patent 2,066,975, JP-A-59-10539, and JP-B-57-19765. Examples of hindered phenols are described in U.S. Pat. Nos. 3,700,455, and 4,228,235, JP-A-52-72224, and JP-B-52-6623. Examples of gallic acid derivatives, methylenedioxybenzenes, and aminophenols are described in U.S. Pat. Nos. 3,457,079, and 4,332,886, and JP-B-56-2i144. Examples of hindered amines are described in U.S. Pat. Nos. 3,336,135, and 4,268,593, British Patents 1,326,889, 1,354,313, and 1,410,846, JP-B-51-1420, and JP-A-58-114036, JP-A-59-53846, and JP-A-59-78344. Examples of metal complexes are described in U.S. Pat. Nos. 4,050,938, and 4,241,155, and British Patent 2,027,731(A). These compounds can be incorporated in the light-sensitive material in the form of a coemulsion with the corresponding color coupler in an amount of 5 to 100% by weight based thereon to accomplish the objects of the present invention. In order to inhibit a deterioration of cyan dye images due to heat, particularly light, an ultraviolet absorbent can be present in the cyan color layer and its adjacent layers.

Examples of suitable ultraviolet absorbents are a benzotriazole compound substituted by aryl group (as described in U.S. Pat. No. 3,533,794), a 4-thiazolidone compound (as described in U.S. Pat. Nos. 3,314,794, and 3,352,681), a benzophenone compound (as described in JP- A-46-2784), a cinnamic ester compound (as described in U.S. Pat. Nos. 3,705,805, and 3,707,395), a butadiene compound (as described in U.S. Pat. No. 4,045,229) or a benzoxazole compound (as described in U.S. Pat. Nos. 3,406,070, 3,677,672, and 4,271,307). Alternatively, ultraviolet-absorbing couplers (e.g., α-naphtholic cyan dye-forming coupler) or ultraviolet-absorbing polymers can be used. The ultraviolet absobents may be mordanted in specific layers, if desired.

The above described benzotriazole compounds substituted with an aryl group are particularly preferred of these ultraviolet absorbents.

The light-sensitive material of the present invention may advantageously comprise a dye image preservability improving compound as described in EP 0 277 589 A2 in combination with the couplers present. In particular, such a compound may be advantageously used in combination with pyrazoloazole couplers.

In particular, a compound (F) which chemically bonds with an aromatic amine developing agent remaining after color development to produce a chemically inert and substantially colorless compound and/or a compound (G) which chemically bonds with an oxidation product of an aromatic amine developing agent remaining after color development to produce a chemically inert and substantially colorless compound can be used at the same time with or separately of these couplers, e.g., to inhibit stain and other side effects due to the production of colored dyes caused by the reaction of these couplers with the color developing agent or oxidation product thereof remaining in the film during storage after processing.

As Compound (F), a compound which undergoes a second order reaction with p-anisidine in trioctyl phosphate at a temperature of 80° C. at a rate $K_2$ of 1.0 1/mol.sec to $1\times10^{-5}$ 1/mol.sec is advantageously used. The second order reaction rate can be determined by the method as described in JP-A-63-158545.

Preferred examples of Compound (G) which chemically bonds with an oxidation product of an aromatic amine developing agent remaining after color development to produce a chemically inert and substantially colorless compound are represented by the general formula (GI):

$$R—Z \qquad \text{(GI)}$$

wherein R represents an aliphatic, aromatic or heterocyclic group; and Z represents a nucleophilic group or a group which decomposes in the light-sensitive material to release a nucleophilic group. The compound represented by the general formula (GI) is preferably a group having a Pearson's nucleophilic $^{n}CH_3I$ value (R. G. Pearson, *Journal of the American Chemical Society*, 90, 319 (1968)) of 5 or more or a group derived therefrom.

Specific preferred examples of compounds represented by the general formula (GI) include those described in EP-A-255772, EP-A-298321 and EP-A-277589, JP-A-62-143048 and JP-A-62-229145, and Japanese Patent Application Nos. 63-136724 and 62-214681.

A combination of Compound (G) and Compound (F) is further described in EP-A-277589.

Gelatin can be advantageously used as a binder or protective colloid incorporated in the emulsion layer in the light-sensitive material of the present invention. Other hydrophilic colloids can be used singly or in combination with gelatin.

Examples of gelatins to be used in the present invention include lime-treated gelatin or acid-treated gelatin. The preparation of gelatin is further described in Arthur Vice, *The Macromolecular Chemistry of Gelatin,* Academic Press, 1964.

The term "reflective support" as used herein means a material which improves the reflectivity to make dye images formed on the silver halide emulsion layer clear. Examples of suitable reflective supports include materials coated with a hydrophobic resin comprising a light reflecting substance such as titanium oxide, zinc oxide, calcium carbonate and calcium sulfate dispersed therein and materials comprising a hydrophobic resin comprising a light relfecting substance dispersed therein. Specific examples of such materials include polyethylene-coated paper, polypropylene synthetic paper, a transparent support such as a glass plate comprising a reflective layer or a reflective substance, a polyester film such as polyethylene terephthalate, cellulose triacetate and cellulose nitrate, a polyamide film, a polycarbonate film, a polystyrene film, and a vinyl chloride resin.

The reflective support to be used in the present invention preferably comprises the above described white pigment in an amount of 12% by weight or more, more preferably 14% by weight or more.

In the present invention, supports having a metallic surface with a secondary diffusion reflecting or may preferably be used. "Secondary diffusion reflection" is disclosed in U.S. Pat. No. 4,851,327, columns 3 to 6. The U.S. Patent is hereby incorporated by reference. The metallic surface preferably has a spectral reflectance of 0.5 or more in the visible wavelength range. Alternatively, the metallic surface may be toughened or a metallic powder used to provide diffused reflectivity. Examples of metals which can be used include aluminum, tin, silver, magnesium or an alloy thereof. The surface of the support may be a metal plate, a metal foil or a thin metal layer obtained by rolling, vacuum deposition or plating. In particular, a metal is preferably vacuum-deposited on other substrates to obtain such a metallic surface. A water-resistant resin layer, particularly thermoplastic resin layer is preferably provided on such a metallic surface. An antistatic layer also is preferably provided on the surface opposite the metallic surface. These supports are further described in JP-A-6i-210346, JP-A-63-24247, JP-A-63-24251 and JP-A-63-24255.

These supports can be appropriately selected depending on the purpose of use.

Examples of light reflecting substances are a white pigment which has been thorughly kneaded in the presence of a surface active agent. The surface of the pigment is preferably treated with a divalent, trivalent or tetravalent alcohol before use.

The specified percentage area of fine white pigment grains present per unit area can be generally determined by dividing the observed area into adjacent 6 $\mu m \times 6$ $\mu m$ unit areas, and then measuring the percentage area of grains projected on the unit area (%)($R_i$). The variation in the percentage occupied area (%) can be determined by the ratio ($s/\bar{R}$) of the average of $R_i$ ($\bar{R}$) to the standard deviation s of Ri. The number (n) of unit areas to be measured is preferably 6 or more. Accordingly, $s/\bar{R}$ an be represented by the following equation:

$$s/\bar{R} = \sqrt{\frac{\sum_{i=1}^{n} (R_i - \bar{R})^2}{n-1}} \Big/ \frac{\sum_{i=1}^{n} R_i}{n}$$

In the present invention, the variation in the percentage occupied area (%) of fine pigment grains is preferably in the range of 0.15 or less, particularly 0.12 or less. When this degree of variation is 0.08 or less, the grains can be said to have a substantially "uniform" dispersibility.

The desired optical reflection density in the present invention is 0.70 or more, preferably 0.7 to 2.0, more preferably 0.8 to 1.9, most preferably 1.0 to 1.8 at a measured wavelength of 680 nm. The ratio of the optical reflection density at 550 nm to that at 680 nm is preferably 1 or less, more preferably 0.8 or less, more preferably 0.6 or less, most preferably 0.2 to 0.5. Further, the optical reflection density at 470 nm is preferably 0.2 or more, more preferably 0.3 or more.

The dyes to be used for this purpose can be selected from those which don't substantially spectrally sensitize silver halide.

The incorporation of these dyes in the system can be accomplished by any commonly used methods. For example, these dyes may be incorporated in the system in the form of aqueous solution or solution in alcohol such as methanol.

For the added of these dyes present, the following amounts are generally appropriate.

| | |
|---|---|
| Cyan dye: | 20 mg/m$^2$–100 mg/m$^2$ (most preferred value); |
| Magenta dye: | 0–50 mg/m$^2$ (preferred value); 0–10 mg/m$^2$ (most preferred value) |
| Yellow dye: | 0–30 mg/m$^2$ (preferred value); 5–20 mg/m$^2$ (most preferred value) |

The dyes incorporated in these layers more preferably diffuse in all the layers rather than being fixed in specific layers between coating and drying of the light-sensitive material to attain the effects of the present invention and inhibit an increase in the manufacturing cost due the addition of specific layers.

Examples of dyes which can be used in the present invention include oxonol dyes containing pyrazolone nucleus or barbituric acid nucleus as described in British Patents 506,385, 1,177,429, 1,311,884, 1,338,799, 1,385,371, 1,467,214, 1,433,102, and 1,553,516, JP-A-48-85130, JP-A-49-114420, JP-A-52-117123, JP-A-55-161233, and JP-A-59-111640, JP-B-39-22069, JP-B-43-13168, and JP-B-62-273527, and U.S. Pat. Nos. 3,247,127, 3,469,985, and 4,078,933, other oxonol dyes as described in U.S. Pat. Nos. 2,533,472, and 3,379,533, and British Patent 1,278,621, azo dyes as described in British Patents 575,691, 680,631, 599,623, 786,907, 907,125, and 1,045,609, U.S. Pat. No. 4,255,326, and JP-A-59-211043, azomethine dyes as described in JP-A-50-100116, and JP-A-54-118247, and British Patents 2,014,598, and 750,031, anthraquinone dyes as described in U.S. Patent 2,865,752, arylidene dyes as described in U.S. Patents 2,538,009, 2,688,541, and 2,538,008, British Patents 584,609, and 1,210,252, JP-A-50-40625, JP-A-51-3623, JP-A-51-10927, and JP-A-54-118247, and JP-B-48-3286, and JP-B-52-37303, styryl dyes as described in JP-B-28-3082, JP-B-44-16594, and JP-B-59-28898, triarylmethane dyes as described in British Patents 446,583, and 1,335,422, and JP-A-59-228250, melocyanine dyes as described in British Patents 1,075,653, 1,153,341, 1,284,730, 1,475,228, and 1,542,807, and cyanine dyes as described in U.S. Pat. Nos. 2,843,486, and 3,294,539.

Among these dyes, those which can be particularly preferably used in the present invention are compounds described in EP-A-337490, pp. 9 to 71.

In order to improve shaprness, an anti-halation layer may be preferably provided on the silver halide emulsion coated side or back side of the support. In order to render the display observable by reflected light or transmitted, the transmission density of the support may be preferably predetermined to 0.35 to 0.8.

The light-sensitive material of the present invention may be exposed to visible light or infrared light. The exposure can be accomplished by a low intensity exposure or by a high intensity exposure for a short period of time. In the latter exposure process, laser scanning exposure process with an exposure time of less than $10^{-4}$ sec. per picture element may be advantageously employed.

For exposure, a band stop filter as described in U.S. Pat. No. 4,880,726 can be advantageously used. With this band stop filter, light color stain can be eliminated, remarkably improving color reproducibility.

The light-sensitive material which has been thus exposed is preferably subjected to blix after color development for the purpose of rapid processing. In particular, if the above described high chloride content silver emulsion is used, the pH of the blix solution is preferably in the range of about 6.5 or less, more preferably about 6 or less, for the purpose of accelerating desilvering.

The silver halide emulsions and other materials (e.g., additives) which can be used in the light-sensitive material of the present invention, i.e., in the photographic layers of the light-sensitive material (e.g., layer arrangement), and processing methods and processing additives to be used in the processing of the light-sensitive material especially, a silver halide color photographic material of the present invention wherein the optical reflection density thereof at 680 nm is 0.50 or more and the total coated amount of silver halide emulsion on the support is adjusted to 0.78 g/m$^2$ or less, calculated in terms of silver, preferably are those described in the following patents, particularly European Patent EP 0 355 660 A2 (corresponding to Japanese patent application No. 1-107011).

| Photographic Element, etc. | JP-A-62-215272 | JP-A-2-33144 | EP 0,355,660A2 |
|---|---|---|---|
| Silver Halide Emulsions | Line 6 on upper right column of p. 10-line 5 on lower left column of p. 12 & last line 4, of lower right column of p. 12 - line 17, on upper left column of p 13 | Line 16 on upper right column of p. 28-line 11, on lower right column of p. 29 & line 2–line 5 on p. 30 | Line 53 on p. 45-line 3 on p. 47 & line 20-line 22 on p. 47 |
| Silver Halide Solvents | Line 6–line 14, on lower left column of p. 12 & last line 3 on lower left column of p. 13 - bottom of lower left column on p. 18 | — | — |
| Chemical Sensitizers | Last line 3, on lower left column - last line 5, on lower right column of p. 12 & line 1, on lower right column of p. 18 - last line 9, on upper right column on p. 22 | Line 12 - bottom of lower right column of p. 29 | Line 4–line 9 on p 47 |
| Spectral Sensitizers (spectral sensitizing processes) | Last line 8, on upper right column of p. 22 - bottom of p. 38 | Line 1–line 13, on upper left column of p. 30 | Line 10–line 15 on p 47 |
| Emulsion Stabilizers | Line 1 on upper left column of p. 39 - bottom of upper right column of p. 72 | Line 14 on upper left column - line 1, on upper right column of p. 30 | Line 16–line 19 on p. 47 |
| Development Accelerators | Line 1 on lower left column of p. 72 - line 3, upper right column of p. 91 | — | — |
| Color Couplers (cyan, magenta, yellow) | Line 4 on upper right column of p. 91 - line 6, on upper left column of p. 121 | Line 14 on upper right column of p. 3 - bottom of upper left column of p 18 & line 6 on upper right column of p. 30 - line 11, on lower right column of p. 35 | Line 15–line 27 on p. 4, line 30 on p 5 - bottom of p. 28 line 29–line 31 on p. 45 & line 23 on p. 47 - line 50 on p. 63 |
| Color Development Accelerators | Line 7 on upper right column of p. 121 - line 1, on upper right column of p. 125 | — | — |
| Ultraviolet Absorbents | Line 2 on upper right column of p. 125 - bottom of lower left column of p. 127 | Line 14 on lower right column of p. 37 - line 11, on upper left column of p 38 | Line 22–line 31 on line, p. 65 |
| Discoloration Inhibitors (image | Line 1 on lower right column of p 127 - line 8, on lower left column of | Line 12 on upper right column of p. 36 - line 19, on upper left column of | Line 30 on p 4 - line 23 on p. 5, line 1 on 29 - line 25 on |

-continued

| Photographic Element, etc. | JP-A-62-215272 | JP-A-2-33144 | EP 0,355,660A2 |
|---|---|---|---|
| stabilizer) | p. 137 | p 37 | p. 45, line 33–line 40 on p. 45 & line 2–line 21 on p. 65 |
| High Boiling and/or Low Boiling Organic Solvents | Line 9 on lower left column of p. 137 - bottom of upper right column of p. 144 Line 1, lower | Line 14 on lower right column of p. 35 - last line 4, on upper left column of p. 36 | Line 1–line 51 on p. 64 |
| Dispersion Processes | Line 1 on lower left column of p. 144 - line 7 on lower right column of p. 146 | Line 10 on lower right column of p. 27 - bottom of upper left column of p. 28/line 12 on lower right column of p. 35 - line 7 on upper right column of p. 36 | Line 51 on p. 63 - line 56 on p. 64 |
| Film Hardeners | Line 8, on upper right column of p. 146 - line 4 on lower left column of p. 155 | — | — |
| Developing Agent Precursors | Line 5 on lower left column of p. 155 - lone 2 on lower right column of p. 155 | — | — |
| Development Inhibitor-Releasing Compounds | Line 3–line 9, on lower left column of p. 155 | — | — |
| Supports | Line 19 on lower right column of p. 155 - line 14 on upper left column of p. 156 | Line 18 on upper right column of p. 38 - line 3 on upper left column of p. 39 | Line 29 on p. 66 - line 13 on p. 67 |
| Light-Sensitive Layer Structure | Line 15 on upper left column of p. 156 - line 14 on lower left column of p. 156 | Line 1–line 15 on right column of p. 28 | Line 41–line 52 on p. 45 |
| Dyes | Line 15 on lower right column of p. 156 - bottom of lower right column of p. 184 | Line 12 on lower right column - line 7 on upper right column of p. 38 | Line 18–line 22 on p. 66 |
| Color Stain Inhibitors | Line 1 on upper left column of p. 185 - line 3 on lower right column of p. 188 | Line 8–line 11 on upper right of p. 36 | Line 57 on p. 64 - line 1 on p. 65 |
| Gradation Adjustors | Line 4–line 8 on lower right column of p. 188 | — | — |
| Stain Inhibitors | Line 9 on lower right column of p. 188 - line 10 on lower right column of p. 193 | Bottom of upper left column - line 13 on lower right column of p. 37 | Line 32 on p. 65 line 17 on p. 66 |
| Surface Active Agents | Line 1 on lower left column of p. 201 - bottom of upper right column of p. 210 | Line 1 on upper right column of p. 18 - bottom of lower right column of p. 24 & last line 10 on lower left column - line 9 lower right column of p. 27 | — |
| Fluorine-Containing Compounds (as antistatic agents, coating aids, lubricants, adhesion inhibitors, etc.) | Line 1 on lower left column of p. 210 - line 5, lower left column of p. 222 | Line 1 on upper left column of p. 25 - line 9 on lower right column of p. 27 | — |
| Binder (hydrophilic colloids) | Line 6 on lower left column of p. 222 - bottom of upper left column of p. 225 | Line 8–line 18 on upper left column of p. 38 | Line 23–line 28 of p. 66 |
| Thickener | Line 1 on upper right column of p. 225 - line 2 on upper right column of p. 227 | — | — |
| Anti-Static Agent | Line 3 on upper right column of p. 227 - line 1 on upper left column of p. 230 | — | — |
| Polymer Latex | Line 2 on upper left column of p. 230 - bottom of p. 239 | — | — |
| Matting Agent | Line 1 of upper left column last line, upper right column of p. 240 | — | — |
| Photographic Processing (processing, additives, | Line 7 on upper right column of p. 3 - line 5 on upper right column of p. 10 | Line 4 on upper left column of p. 39 - bottom of upper left column of p. 42 | Line 14 on p. 67 - line 28 on p. 69 |

-continued

| Photographic Element, etc. | JP-A-62-215272 | JP-A-2-33144 | EP 0,355,660A2 |
|---|---|---|---|
| etc.) | | | |

JP-A-62-215272 includes amendments filed on March 16, 1987 appended thereto.

Of the above described color couplers, so-called short wavelength type yellow couplers as described in JP-A-63-231451, JP-A-63-123047, JP-A-63-241547, JP-A-1-173499, JP-A-1-213648, and JP-A-1-250944 are preferably used as yellow coupler.

As cyan couplers, 3-hydroxypyridine cyan couplers as described in EP 0,333,185A2 (particularly preferred of these couplers are those obtained by incorporating a chlorine-eliminating group in 4-equivalent coupler in Exemplary Coupler (42) so that it is converted to 2-equivalent coupler, and Exemplary Couplers (6) and (9) ) and cyclic active methylene cyan couplers as described in JP-A-64-32260 (particularly preferred of these couplers are Exemplary Couplers 3, 8, and 34), in addition to diphenylimidazole cyan couplers as described in JP-A-2-33144 can be advantageously used.

The color photographic light-sensitive material of the present invention is subjected to color development, blix, and rinse (or stabilization). Bleach and fixing may be separately effected instead of in a monobath.

The color developer to be used in the present color development comprises a known aromatic primary amine color developing agent. Preferred examples include an aromatic primary amine color developing agent such as p-phenylenediamine derivatives. Specific examples of p-phenylenediamine derivatives are set forth below, but the present invention should not be construed as being limited thereto.

D-1: N,N-diethyl-p-phenylenediamine
D-2: 2-Amino-5-diethylaminotoluene
D-3: 2-Amino-5-(N-ethyl-N-laurylamino)toluene
D-4: 4-[N-ethyl-N-(β-hydroxyethyl)amino]aniline
D-5: 2-Methyl-4-[N-ethyl-N-[β-hydroxyethyl-)amino]aniline
D-6: 4-Amino-3-methyl-N-ethyl-N-[β-(methanesulfonamide)ethyl]aniline
D-7: N-(2-amino-5-diethylaminophenylethyl )methanesulfonamide
D-8: N,N-dimethyl-p-phenylenediamine
D-9: 4-Amino-3-methyl-N-ethyl-N-methoxyethylaniline
D-10: 4-Amino-3-methyl-N-ethyl-N-β-ethoxyethylaniline
D-11: 4-Amino-3-methyl-N-ethyl-N-β-butoxyethylaniline Particularly preferred of these p-phenylenediamine derivatives is 4-amino-3-methyl-N-ethyl-N-[β(methanesulfonamido)ethyl]-aniline (Compound D-6).

These p-phenylenediamine derivatives may be used in the form of a salt thereof such as the sulfate, hydrochloride, sulfite and p-toluenesulfonate thereof. The amount of the aromatic primary amine color developing agent to be used is preferably in the range of about 0.1 g to about 20 g, more preferably about 0.5 g to about 10 g per l of color developer.

A developer substantially free of benzyl alcohol is preferably used in the present invention. The term "substantially free of benzyl alcohol" as used herein means "containing benzyl alcohol in an amount of preferably 2 ml/l or less, more preferably 0.5 ml/l or less, most preferably none."

The developer to be used in the present invention is substantially free of sulfite ions to accomplish the objects of the present invention.

The term "substantially free of sulfite ions" as used herein means "containing sulfite ions in an amount of $3.0\times10^{-3}$ mol/l or less, more preferably none."

However, in the present invention, an extremely small amount of sulfite ions used to inhibit the oxidation of a processing agent kit comprising a concentrated developing agent which is to be diluted before use is may be contained.

The developer to be used in the present invention needs to be substantially free of sulfite ions. Further, the developer needs to be substantially free of hydroxylamine as well.

While not completely clear, the reason is probably because hydroxylamine not only serves as developer preservative but also exhibits silver development activity itself, greatly affecting the photographic properties when its concentration varies.

The term "substantially free of hydroxylamine" as used herein means "containing hydroxylamine in an amount of $5.0\times10^{-3}$ mol/l or less, more preferably none."

More preferably, the developer to be used in the present invention comprises an organic preservative instead of hydroxylamine or sulfite ions.

Suitable organic preservatives are organic compounds which reduce the deterioration rate of an aromatic primary amine color developing agent when incorporated in a color photographic light-sensitive material, i.e., an organic compound which inhibits the oxidation of the color developing agent by air or the like. In particular, hydroxylamine derivatives (It means that hydroxylamine itself is excluded hereinafter the same), hydroxamic acids, hydrazines, hydrazides, phenols, α-hydroxyketones, α-aminoketones, saccharides, monoamines, diamines, polyamines, tertiary ammonium salts, nitroxy radicals, alcohols, oximes, diamide compounds, and condensed ring amines are effective organic preservatives. These compounds are disclosed in JP-A-63-4235, JP-A-63-30845, JP-A-63-21647, JP-A-63-44655, JP-A-63-53551, JP-A-63-43140, JP-A-63-56654, JP-A-63-58346, JP-A-63-43138, JP-A-63-146041, JP-A-63-44657, JP-A-63-44656, and JP-A-52-143020, U.S. Pat. Nos. 3,615,503, and 2,494,903, and JP-B-48-30496.

Other examples of preservatives which can be incorporated in the color developer, as desired, include various metals as described in JP-A-57-44148 and JP-A-57-53749, salicylic acids as described in JP-A-59-180588, alkanolamines as described in JP-A-54-3582, polyethyleneimines as described in JP-A-56-94349, and aromatic polyhydroxy compounds as described in U.S. Pat. No. 3,746,544. in particular, alkanolamines such as triethanolamine, dialkylhydroxylamine such as diethylhydroxylamine, hydrazine derivatives or aromatic polyhydroxy compounds can be advantageously used.

Particularly preferred of these organic preservatives are hydroxylamine derivatives and hydrazine derivatives (e.g., hydrazines, hydrazides). These compounds are further described in Japanese Patent Application Nos. 62-255270, 63-9713, 63-9714, and 63-11300.

The above described hydroxylamine derivative or hydrazine derivative may be advantageously used in combination with amines to improve the stability of the color developer and hence the stability during continuous processing.

Examples of the above described amines include the cyclic amines as described in JP-A-63-239447, amines as described in JP-A-63-128340, and the amines as described in JP-A-63-9713 and JP-A-63-11300.

In the present invention, the color developer preferably contains chlorine ions in an amount of $3.5\times10^{-2}$ to $1.5\times10^{-1}$ mol/l, particularly $4\times10^{-2}$ to $1\times10^{-1}$ mol/l. If the amount exceeds $1.5\times10^{-1}$, development is disadvantageously retarded, making it difficult to accomplish the objects of the present invention, i.e., rapid processing and high maximum density. On the contrary, if the amount is below $3.5\times10^{-2}$ mol/l, the inhibition of fog is poor.

In the present invention, the color developer preferably contains bromine ions in an amount of $3.0\times10^{-5}$ to $1.0\times10^{-3}$ mol/l, more preferably $5.0\times10^{-5}$ to $5\times10^{-4}$ mol/l. If the amount exceeds $1\times10^{-3}$ mol/l, development is retarded and maximum density and sensitivity are reduced. On the contrary, if the amount is below $3.0\times10^{-5}$ mol/l, inhibition of fog to a sufficient extent is not achieved.

Chlorine ions and bromine ions may be directly added to the developer or may be eluted from the light-sensitive material into the developer during development.

Examples of chlorine ion-supplying materials which can be directly added to the color developer include sodium chloride, potassium chloride, ammonium chloride, lithium chloride, nickel chloride, magnesium chloride, manganese chloride, calcium chloride, and cadmium chloride. Preferred of these materials are sodium chloride and potassium chloride.

Alternatively, chlorine ions may be supplied from a fluorescent brightening agent incorporated in the developer.

Examples of bromine ion-supplying materials include sodium bromide, potassium bromide, ammonium bromide, lithium bromide, calcium bromide, magnesium bromide, manganese bromide, nickel bromide, cadmium bromide, serium bromide, and thallium bromide. Preferred of these materials are potassium bromide and sodium bromide.

If chlorine or bromine ions are eluted from the light-sensitive material during development, they may be both supplied from an emulsion or other parts of the material.

The color developer to be used in the present invention preferably has a pH of 9 to 12, more preferably ably 9.0 to 11.0. The color developer may further include compounds conventionally present in color developers.

Various buffers are used to maintain the above specified pH range. Examples of suitable buffers which can be used are carbonates, phosphates, borates, tetraborates, hydroxybenzoates, glycyl salts, N,N-dimethylglycine salts, leucine salts, norleucine salts, guanine salts, 3,4-dihydroxyphenylalanine salts, alanine salts, aminobutyrates, 2-amino-2-methyl-1,3-propanediol salts, valine salts, proline salts, trishydroxyaminomethane salts, and lysine salts. In particular, carbonates, phosphates, tetraborates, and hydroxybenzoates are advantageous because they have excellent buffering capacity in a high pH range as 9.0 or more and thus do not adversely affect the photographic properties (e.g., fog) even when added to the color developer. Thus, these buffers are particularly preferred.

Specific examples of buffers include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate ), and potassium 5-sulfo-2-hydroxybenzoate (potassium 5-sulfosalicylate). However, the present invention is not to be construed as being limited to these compounds.

The amount of the buffer to be incorporated in the color developer is preferably in the range of 0.1 mol/l or more, particularly 0.1 to 0.4 mol/l.

The color developer may further include various chelating agents as calcium or magnesium suspending agents or to improve the stability thereof. Specific examples of suitable organic acid compounds include nitrilotriacetic acid, diethylenetriaminepentaacetic acid, ethylenediaminetetraacetic acid, N,N,N-trimethylenephosphonic acid, ethylenediamine-N,N,N',N'-tetramethylenephosphonic acid, transcyclohexanediaminetetraacetic acid, 1,2-diaminopropanetetraacetic acid, glycoletherdiaminetetraacetic acid, ethylenediamineorthohydroxyphenylacetic acid, 2-phosphonobutane-1,2,4-tricarboxylic acid, 1-hydroxyethylidene-1,1-diphosphonic acid, and N,N'-bis( 2-hydroxybenzyl )ethylenediamine-N,N'-diacetic acid.

Two or more chelating agents can be used in combination, if desired.

The appropriate amount of such a chelating agent to be incorporated in the color developer is an amount such that metallic ions in the color developer are blocked, e.g., 0.1 g to 10 g/l.

The color developer may optionally include any known development accelerators.

Examples of development accelerators which can be incorporated in the color developer include thioether compounds as disclosed in JP-B-37-16088, JP-B-37-5987, JP-B-38-7826, JP-B-44-12380, and JP-B-45-9019, and U.S. Pat. No. 3,813,247, p-phenylenediamine compounds as disclosed in JP-A-52-49829 and JP-A-50-15554, tertiary ammonium salts as disclosed in JP-A-50-137726, JP-A-56-156826 and JP-A-52-43429, and JP-B-44-30074, amine compounds as disclosed in U.S. Pat. Nos. 2,494,903, 3,128,182, 4,230,796, 3,253,919, and 2,482,546, and JP-B-41-11431, polyalkylene oxides as disclosed in JP-B-37-16088, JP-B-42-25201, JP-B-41-11431, and JP-B-42-23883, and U.S. Pat. Nos. 3,128,183, and 3,532,501, and imidazoles such as 2-methylimidazole and imidazole.

The color developer to be used in the present invention can include any known fog inhibitors, if desired. A halide of an alkali metal such as sodium chloride, potassium bromide and potassium iodide or an organic fog inhibitor can be used as a fog inhibitor. Typical examples of organic fog inhibitors include nitrogen-containing heterocyclic compounds such as benzotriazole, 6-nitrobenzimidazole, 5-nitroindazole, 5-methylbenzotriazole, 5-nitrobenzotriazole, 5-chlorobenzotriazole, 2-thiazolyl-benzimidazole, 2-thiazolylmethyl-benzimidazole, indazole, hydroxyazaindolidine, and adenine.

The color developer to be used in the present invention may contain a fluorescent brightening agent. Examples of fluorescent brightening agents which are preferably used include 4,4'-diamino-2,2'-disulfostilbene compounds. The amount of fluorescent brightening agent to be incorporated in the color developer is in the range of 0 to 5 g/l, preferably 0.1 to 4 g/l.

The color developer to be used in the present invention may also contain various surface active agents such as alkylsulfonic acids, arylsulfonic acids, aliphatic carboxylic acids and aromatic carboxylic acids as desired.

The temperature at which the processing is effected with the color developer is in the range of 20° to 50° C., preferably 30° to 40° C. The time of processing with the color developer is in the range of 20 seconds to 5 minutes, preferably 30 seconds to 200 minutes. The replenishment rate of the color developer is preferably as low as possible. An appropriate rate is in the range of 20 to 600 ml, preferably 50 to 300 ml, more preferably 60 to 200 ml, most preferably 60 to 150 mi per $m^2$ of the light-sensitive material.

The desilvering process which can be employed in the present invention normally comprises a bleach-fixing step, fixing-blix step, bleach-blix step, blix step, or the like.

The bleaching solution, blix solution and fixing solution which can be used with the present invention are described hereinafter.

The bleaching agent to be used in the bleaching solution or blix solution can be any bleaching agent. In particular, complexes of iron (III) with organic acids (e.g., aminopolycarboxylic acids such as ethylenediaminetetraacetic acid and diethylenetriaminepentaacetic acid, aminopolyphosphonic acid, phosphonocarboxylic acid, organic phosphonic acid), organic acids such as citric acid, tartaric acid and malic acid, persulfates, and hydrogen peroxide are preferably used.

Particularly preferred of these bleaching agents are organic complex salts of iron (III) from the standpoint of rapid processing and environmental protection. Examples of aminopolycarboxylic acids, aminopolyphosphonic acids, organic phosphonic acids and salts thereof useful for the formation of organic complex salts of iron (III) include ethylenediaminetetraacetic acid, diethylenetriaminepentaacetic acid, 1,3-diaminopropanetetraacetic acid, propylenediaminetetraacetic acid, nitrilotriacetic acid, cyclohexanediaminetetraacetic acid, methyliminodiacetic acid, iminodiacetic acid, and glycoletherdiaminetetraacetic acid. These compounds may be used in the form of the sodium salt, the potassium salt, the lithium salt or the ammonium salt. Preferred compounds are complexes of iron (III) with ethylenediaminetetraacetic acid, diethylenetriaminepentaacetic acid, cyclohexanediaminetetraacetic acid 1,3-diaminopropanetetraacetic acid and methyliminodiacetic acid, which exhibit a high bleaching capability. These ferric complexes may be used in the form of complex salts as well. Alternatively, a ferric salt such as ferric sulfate, ferric chloride, ferric nitrate, ferric ammonium sulfate and ferric phosphate and a chelating agent such as an aminopolycarboxylic acid, an aminopolyphosphonic acid and a phosphonocarboxylic acid may be used to form a ferric complex salt in the bleaching solution. The chelating agent may be used in an amount exceeding the amount required to form a ferric complex salt. Preferred iron complexes are aminopolycarboxylic iron complexes. It is generally used in the range of 0.01 to 1.0 mol/l, preferably 0.05 to 0.50 mol/l.

The bleaching bath, blix bath and/or their prebaths may contain various compounds as bleach accelerators. For example, compounds containing a mercapto group or a disulfide bond as described in U.S. Pat. No. 3,893,858, German Patent 1,290,812, JP-A-53-95630, and *Research Disclosure,* No. 17129 (July 1978), thiourea compounds as described in JP-B-45-8506, JP-A-52-20832, and JP-A-53-32735, and U.S. Pat. No. 3,706,561, or halides such as iodide and bromide can be advantageously used because of their excellent bleaching capability.

The bleaching solution or blix solution ,which can be used in the present invention may contain a rehalogenating agent such as bromide (e.g., potassium bromide, sodium bromide, ammonium bromide) and chloride (e.g., potassium chloride, sodium chloride, ammonium chloride). The bleaching solution or blix solution may optionally contain one or more inorganic or organic acids with a pH buffering capability and the alkali metal or ammonium salts thereof such as borax, sodium metaborate, acetic acid, sodium acetate, sodium carbonate, potassium carbonate, phosphorous acid, phosphoric acid, sodium phosphate, citric acid, sodium citrate and tartaric acid or a corrosion inhibitor such as ammonium nitrate and guanidine.

The blix solution or fixing solution may comprise known fixing agents, i.e., thiosulfates such as sodium thiosulfate and ammonium thiosulfate, thiocyanates such as sodium thiocyanate and ammonium thiocyanate, thioether compounds such as ethylenebisthioglycolic acid and 3,6-dithia-l,8-octanediol, and water-soluble silver halide solvents such as thiourea, alone or in admixture. Further, a special blix solution comprising a combination of a fixing agent as described in JP-A-55-155354 and a large amount of a halide such as potassium iodide can be used. In the present invention, thiosulfates, particularly ammonium thiosulfate are advantageously used. The amount of the fixing agent is preferably in the range of 0.3 to 2 mol, more preferably 0.5 to 1.0 mol, per l. The pH of the blix solution or fixing solution is preferably in the range of 3 to 10, more preferably 5 to 9.

Further, the blix solution can include various fluorescent brightening agents, antifoaming agents or surface active agents or organic solvents such as polyvinyl pyrrolidone and methanol.

The blix solution or fixing solution preferably contains a sulfite ion-releasing compound such as a sulfite (e.g., sodium sulfite, potassium sulfite, ammonium sulfite), a bisulfite (e.g., ammonium bisulfite, sodium bisulfite, potassium bisulfite) and a metabisulfite (e.g., potassium metabisulfite, sodium metabisulfite, ammonium metabisulfite) as a preservative. These compounds are preferably present in an amount of about 0.02 to 0.05 mol/l, more preferably 0.04 to 0.40 mol/l, calculated as sulfite ion.

Sulfite is normally used as the preservative. Further, ascorbic acid, a carbonyl-bisulfite acid adduct or a carbonyl compound may be used, if desired.

Further, a buffer, a fluorescent brightening agent, a chelating agent, an anti-foaming agent, a fungicide or the like may be added to the system.

The desilvering process, such as fixing and blix, is normally followed by a rinse and/or stabilization.

The amount of water to be used in the washing can vary widely depending on the characteristics of the light-sensitive material (for example, the kind of couplers, etc. present), the end use of the light-sensitive material, the temperature of the washing water, the number of washing tanks (number of stages), the replenishment system (e.g., a countercurrent system or direct current system), and other various factors. Of these factors, the relationship between the number of washing tanks and the quantity of water in a multistage countercurrent system can be obtained according to the method described in *Journal of the Society of Motion Picture and Television Engineers*, vol. 64, pp. 248–253 (May 1955). In general, the number of stages in the multi-stage countercurrent system is preferably 2 to 6, particularly 2 to 4.

By using the multi-stage countercurrent system, the requisite amount of water can be greatly reduced, e.g., to 0.5 to 1 l or less per $m^2$ of light-sensitive material, remarkably attaining the effects of the present invention. However, bacteria grow due to an increase of the residence time of the water in the tank, and floating masses of bacteria adhere to the light-sensitive material. In the present invention, in order to cope with this problem, the method of reducing calcium and magnesium ion concentrations described in JP-A-62-288838 can be used very effectively. Further, isothiazolone compounds or thiabenzazoles as described in JP-A-57-8542, chlorine type bactericides, e.g., chlorinated sodium isocyanurate, benzotriazole as described in JP-A-61-267761, and bactericides described in Hiroshi Horiguchi, *Bokinbobaizai no kagaku*, Eisei Gijutsu Gakkai (e.), 1982, *Biseibutsu no mekkin, sakkin, bobiqijutsu,* and Nippon Bokin Bobi Gakkai (ed.), *Bokin bobizai jiten,* 1986 can also be effectively used.

The washing water may further contain a surface active agent as water-draining agent or a chelating agent such as EDTA as a water softener.

The rinse step may be followed by stabilization. Alternatively, stabilization processing without a rinse step can be used. The stabilizing solution comprises a compound capable of stabilizing images. Examples of such compounds include aldehyde compounds such as formaldehyde, buffers for providing a pH value of layers composing a photographic material suitable for dye stabilization, and an ammonium compound. In order to inhibit proliferation bacteria in the solution or provide the processed light-sensitive material with anti-fungal properties, the various germicides or fungicides as described above may be used.

Further, the stabilizing solution may include a surface active agent, a fluorescent brightening agent and a film hardener. If the light-sensitive material of the present invention is processed directly with stabilization without passing through a rinse step, the methods as described in JP-A-57-8543, JP-A-58-14834, and JP-A-60-220345 can be used.

In other embodiments, chelating agents such as 1-hydroxyethylidene-1,1-diphosphonic acid and ethylenediaminetetramethylenephosphonic acid or magnesium or bismuth compounds can be used.

As a water-washing solution or a stabilizing solution, used after desilvering rinsing solution may be used in the same way.

The rinsing solution or stabilizing solution preferably has a pH of 4 to 10, more preferably 5 to 8. The temperature at which the processing solution is used can vary widely depending on the end use and properties of the light-sensitive material to be processed but is normally in the range of 15° to 45° C. preferably 20° to 40° C. The rinsing or stabilizing time can be arbitrarily chosen but is preferably as short as possible to reduce the processing time. The rising or stabilizing time is preferably in the range of 15 seconds to 105 seconds, more preferably 30 seconds to 90 seconds. The replenishment rate of the rinsing solution or stabilizing solution is preferably as small as possible in view of running cost, waste and handleability.

In particular, a preferred replenishment rate of the solution is 0.5 to 50 times, preferably 3 to 40 times, the amount of the solution brought over from the prebath per unit area of light-sensitive material, or 1, l or less, preferably 500 ml or less, per $m^2$ of light-sensitive material. The replenishment may be effected continuously or intermittently.

The solution which has been used in the rinse step and/or stabilizing step may be further used in its preceeding step. As an example, in the multi-stage countercurrent system, overflow from the rinsing tank can be introduced into a prebath, i.e., blix bath, which is supplied with a concentrated solution to reduce the amount of waste solution.

The present invention is further described in the following examples, but the present invention should not be construed as being limited thereto. Unless otherwise indicated herein, all parts, percents, ratios and the like are by weight.

EXAMPLE 1

Preparation of Support

On the surface of a white paper (weight: 175 g/$m^2$; thickness: about 180 μm) made of 100% of LBKP (sulfate pulp made of a bleached broadleaf tree) for a photographic paper were each provided white pigment-containing resin layers comprising water-resistant titanium oxide as described below to prepare Supports A, I to VI.

Support A 90 parts by weight of a polyethylene composition (density: 0.920 g/cc; melt index (MI): 5.0 g/10 min.) were kneaded with 10 parts by weight of a titanium oxide white pigment surface-treated with silicon oxide and aluminum oxide. The material was then melt extrusion-coated on the surface of the white paper to obtain a water-resistant resin layer having a thickness of 30 μm On the back side of the white paper was coated another polyethylene composition (density: 0.950 g/cc; Mi: 8.0 g/10 min. ) to obtain a water-resistant resin layer having a thickness of 20 μm.

Support I

To 86 parts by weight of the polyethylene composition as used in Support A were added 14 parts by weight of a surface-treated anatase type titanium oxide white pigment. The materials were kneaded and melt extrusion-coated on the surface of the white paper to obtain a water-resistant resin layer having a thickness of 30 μm.

The same titanium oxide powder as used in Support A was immersed in an ethanol solution of 2,4- dihydroxy-2-methylpentane. The material was then heated to vaporize the ethanol to obtain a surface-treated titanium oxide white pigment. The alcohol was coated on the surface of the grains in an amount of about 1% by weight based on the weight of titanium oxide. On the back side of the white paper was coated a polyethylene composition in the same manner as in Support A to obtain a water-resistant resin layer.

Supports II to V were prepared in the same manner as described above except that the compositions were changed as set forth in Table 1 below.

TABLE 1

| Support No. | Concentration of Titanium Oxide | Thickness |
|---|---|---|
| II | 13 parts by weight | 30 μm |
| III | 10 parts by weight | 30 μm |
| IV | 15 parts by weight | 30 μm |
| V | 20 parts by weight | 30 μm |

Support No. VI 50 parts by weight of a hexacrylate ester of an adduct of 12 mol of dipentaerythritol propylene oxide and 50 parts by weight of futile type titanium oxide were dispersed in admixture in a ball mill for 20 hours or more. The material was then coated and dried on a paper to a dried thickness of 10 μm. The paper used had been provided by providing a 20-μm thick polyethylene composition layer on one surface of the same white paper as used in Support A and a 20-μm thick polyethylene composition layer (density: 0.960 g/cc; MI 25 g/10 min. ) on the other surface thereof.

The coated surface was then irradiated with electron rays at an accelerating voltage of 200 kv and an absorbed dose of 5 mega rad in an atmosphere of nitrogen to obtain Support No. VI.

To evaluate the dispersibility of white pigment grains on the surface of the water-resistant resin layer in the support of the present invention, the samples were subjected to ion sputtering so that the resin was etched to a depth of about 0.05 μm from the surface thereof. White pigment grains on the etched portion were observed under an electron microscope to determine the projected area ratio Ri of 6 grains in a unit area of 6 μm×6 μm. The standard deviation of Ri was calculated by the equation:

$$s = \sqrt{\frac{\sum_{i=1}^{6} (Ri - \bar{R})^2}{n-1}}$$

$$\left( \text{wherein } \bar{R} = \frac{\sum_{i=1}^{6} Ri}{n-1} \right)$$

The percent average grain occupation area ratio $\bar{R}$ was also determined.

The results obtained are set forth in Table 1-a below.

TABLE 1-a

| Support Sample | Coefficient of Variation of Grain Occupied Area Ratio ($s/\bar{R}$) |
|---|---|
| A | 0.25 |
| I | 0.08 |
| II | 0.07 |
| III | 0.08 |
| IV | 0.07 |
| V | 0.08 |
| VI | 0.04 |

As compared to Support No. A, Support Nos. I to VI had excellent white pigment dispersion.

Support No. VII

To a 26-μm polyethylene terephthalate film filled with 2% of silica with an average grain diameter of 3 μm as a synthetic resin film was coated an ethyl acetate solution of an anchor coat composed of 80% by weight of a vinylidene chloride copolymer (vinylidene chloride/vinyl chloride/vinyl acetate/maleic anhydride=16/70/10/4 by mole) and 20% by weight of a trimethylolpropane adduct of tolylenediisocyanate to a dried thickness of 0.1 μm. The material was dried at a temperature of 100° C. in an oven for 2 minutes. On the anchor coat layer of the substrate was vacuum-deposited a 800 Angstrom thick aluminum film layer under $10^5$ tort. The surface roughness was about 40 to 100 unevennesses per mm in the roughness range of 0.1 μm or more. The average surface roughness was about 0.6 μm as determined by a three-dimensional roughness meter.

On the surface of the vacuum-deposited thin film layer was coated an ethyl acetate solution of a copolymer for an adhesive layer composed of 95 parts by weight of a vinylidene chloride/vinyl chloride/vinyl acetate/maleic anhydride copolymer (10/70/17/3 by mole) and 5 parts by weight of an adduct of hexamethylene diisocyanate and trimethylolpropane to a dried thickness of 0.2 g/m$^2$. The material was dried at a temperature of 100° C. in an oven for 2 minutes to obtain an adhesive layer.

A wood pulp comprising 20 parts by weight of LBSP and 80 parts by weight of LBKP was beaten with a disc refiner to a Canadian freeness of 300 cc. To the wood pulp thus processed were added sodium stearate, anionic polyacrylamide, aluminum sulfate, polyamide polyamine epichlorohydrin, and alkyl ketene dimer in amounts of 1.0 part by weight, 0.5 parts by weight, 1.5 parts by weight, 0.5 parts by weight and 0.5 parts by weight based on the absolute dry weight of wood pulp, respectively. A paper was then made from this material using a wire screen paper making machine to prepare a paper with a weight of 160 g/m$^2$.

The density of the paper was adjusted by machine calender to 1.0 g/cm$^3$. The paper was then subjected to corona discharge. On the paper thus processed was extrusion-coated a low density polyethylene (MI: 7 g/10 min.; density: 0.923 g/cc) to a thickness of 30 μm to form a polyethylene resin layer thereon. The other surface of the substrate was then subjected to corona discharge. On the surface of the paper thus corona-discharged was extrusion-coated a high density polyethylene (MI: 8 g/10 min.; density: 0. 950 g/cc ) to prepare a double polyethylene-laminated paper.

On the back side (reverse side from the vacuum-deposited side) of the aluminum-deposited film was coated a two-part system polyurethane adhesive having the following composition to a dried thickness of 3 g/m$^2$.

| | | |
|---|---|---|
| Adhesive: | Polybond AY-651 A (Polyurethane: available from Sanyo Kasei Kogyo K.K.) | 100 parts by weight |
| | Polybond AY-651 C (Polyurethane: available from Sanyo Kasei Kogyo K.K.) | 15 parts by weight |

The material was then dried at a temperature of 100° C. for 2 minutes. The coated surface of the material and the low density polyethylene side of the double polyethylene-laminated paper were placed opposite each other. The laminate was then hot-pressed at a temperature of 80° C. under 10 kg/cm$^2$.

On the adhesive layer was coated a gelatin subbing layer having a thickness of about 0.1 μm. On the polyethylene laminate on the back side of the material was coated an antistatic layer comprising colloidal alumina and polyvinylidene chloride.

Support A was subjected to corona discharge. A gelatin subbing layer comprising sodium dodecylbenzenesulfonate was coated on the support. Various photographic layers were coated on the material to prepare a multi-layer color photographic paper having the following layer structure. The coating solution was prepared as follows:

Preparation of First Layer Coating Solution

To 19.1 g of a yellow coupler (ExY), 4.4 g of a dye image stabilizer (Cpd-1), and 0.7 g of a dye image stabilizer (Cpd-7) were added 27.2 cc of ethyl acetate and 4.1 g of a solvent (Solv-7) so that they dissolved in these solvents. The solution was then emulsion dispersed in 185 cc of a 10% aqueous solution of gelatin containing 8 cc of 10% sodium dodecylbenzenesulfonate to prepare Emulsion Dispersion A. On the other hand, a silver bromochloride Emulsion A (3:7 (molar ratio calculated in terms of silver) mixture of a large grain size Emulsion A comprising cubic grains with an average size of 0.88 μm and a grain size distribution coefficient of variation of 0.08 and a small grain size Emulsion A having cubic grains with an average size of 0.70 μm and a grain size distribution coefficient of variation of 0.10, each emulsion having 0.3 mol % silver bromide localized on a part thereof) was prepared. The emulsion comprised blue-sensitizing Dyes A and B as described below in amounts of $2.0\times10^{-4}$ mol each for large grain size Emulsion A and $2.5\times10^{-4}$ mol each for the small grain size Emulsion A, respectively. The chemical sensitization of the emulsion was effected with a sulfur sensitizer and a gold sensitizer. Emulsion Dispersion A and the silver bromochloride Emulsion A were then mixed and dissolved to prepare a First Layer coating solution having the composition as described below.

The coating solutions for the second to seventh Layers were prepared in the same manner as in the First Layer coating solution. The sodium salt of 1-oxy-3,5-dichloro-s-triazine was added to each of these layers as a gelatin hardener.

To each of these layers was added Cpd-10 and Cpd-11 in amounts of 25.0 mg/m$^2$ and 50.0 mg/m$^2$, respectively.

The silver bromochloride emulsion to be incorporated in the various light-sensitive emulsion layers comprised the following spectral sensitizing dyes:

Sensitizing Dye A for Blue-Sensitive Emulsion Layer

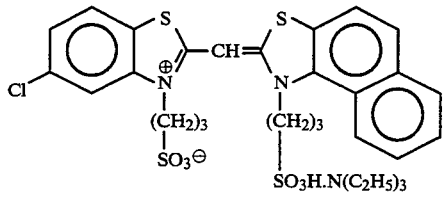

Sensitizing Dye B for Blue-Sensitive Emulsion Layer

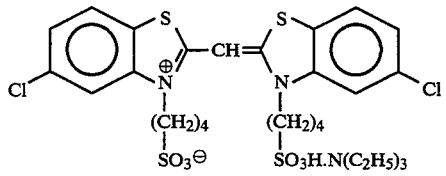

($2.0\times10^{-4}$ mol each for large grain size Emulsion A and $2.5\times10^{-4}$ mol each for small grain size Emulsion A per mol of silver halide)

Sensitizing Dye C for Green-Sensitive Emulsion Layer

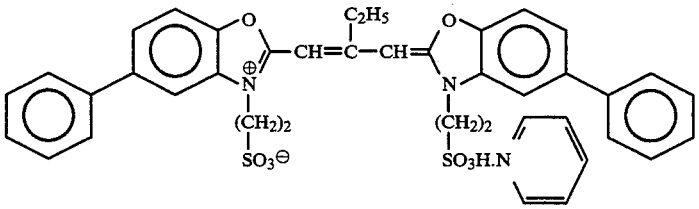

($4.0\times10^{-4}$ mol each for large grain size Emulsion B described later and $5.6\times10^{-4}$ mol each for small grain size Emulsion B described later per mol of silver halide)

Sensitizing Dye D for Green-Sensitive Emulsion Layer

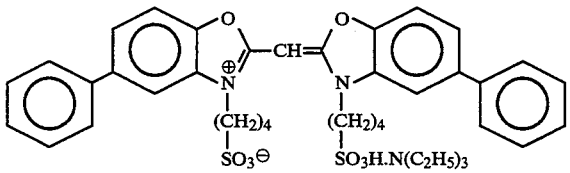

($7.0\times10^{-5}$ mol each for large grain size Emulsion B and $1.0\times10^{-5}$ mol each for small grain size Emulsion B per mol of silver halide)

Sensitizing Dye E for Red-Sensitive Emulsion Layer

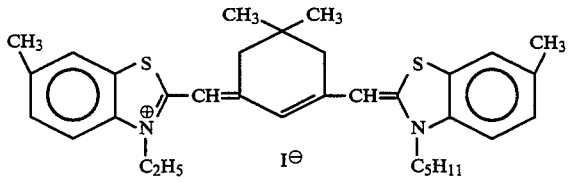

($0.9\times10^{-4}$ mol per mol of silver halide)

To the red-sensitive emulsion layer was incorporated the following compound in an amount of $2.6\times10^{-3}$ mol per mol of silver halide;

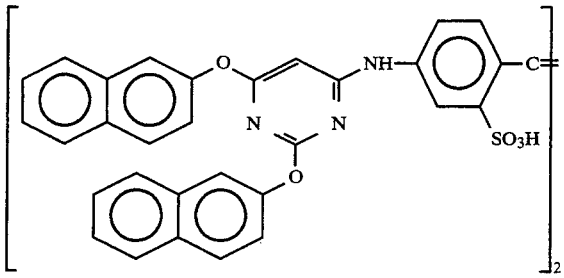

To the blue-sensitive emulsion layer, the green-sensitive emulsion layer and the red-sensitive emulsion layer were added 1-(5-methylureidophenyl)-5-mercaptotetrazole in amounts of $8.5\times10^{-5}$ mol, $7.7\times10^{-4}$ mol and $2.5\times10^{-4}$ mol per mol of silver halide, respectively.

To the blue-sensitive emulsion layer and green-sensitive emulsion layer were added 4-hydroxy-6-methyl-1,3,3a-tetrazaindene in amounts of $1\times10^{-4}$ mol and $2\times10^{-4}$ mol per mol of silver halide, respectively.

In order to inhibit irradiation, the following dyes were added to these emulsion layers (the figure in parenthesis indicates the coated amount).

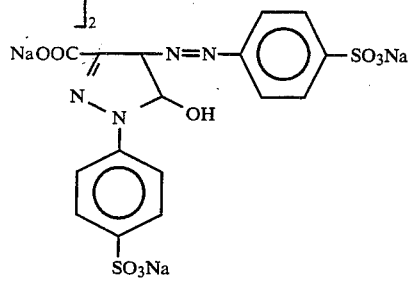

(10 mg/m²)

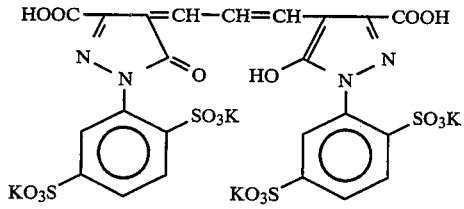

(10 mg/m²)

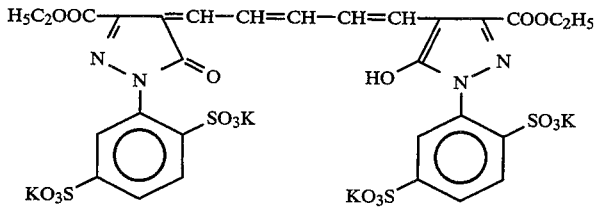

(40 mg/m²)

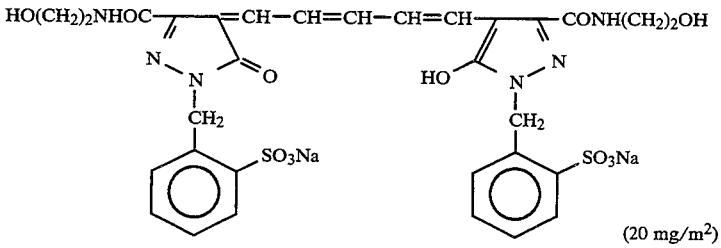

(20 mg/m²)

Layer Structure

The compositions of the various layers are set forth below. The figures indicate the coated amount (g/m²). The coated amount of silver halide emulsion is represented as calculated in terms of silver.

| | |
|---|---|
| Support: | |
| Polyethylene-laminated paper [containing a white pigment ($TiO_2$) and a bluish dye (ultramarine) on the 1st layer side] | |
| First Layer (blue-sensitive emulsion layer) | |
| Silver bromochloride Emulsion A as set forth above | 0.30 |
| Gelatin | 1.86 |
| Yellow Coupler (ExY) | 0.82 |
| Dye Image Stabilizer (Cpd-1) | 0.19 |
| Solvent (Solv-3) | 0.18 |

-continued

| | |
|---|---|
| Solvent (Solv-7) | 0.18 |
| Dye Image Stabilizer (Cpd-7) | 0.06 |
| Second Layer (color stain inhibiting layer) | |
| Gelatin | 0.99 |
| Color Stain Inhibitor (Cpd-5) | 0.08 |
| Solvent (Solv-1) | 0.16 |
| Solvent (Solv-4) | 0.08 |
| Third Layer (green-sensitive emulsion layer) | |
| Silver Bromochloride Emulsion (1:3 (molar ratio, calculated in terms of silver) mixture of a large grain size Emulsion B comprising cubic grains with an average size of 0.55 μm and a grain size distribution coefficient of variation of 0.10 and a small grain size Emulsion B having cubic grains with an average size of 0.39 μm and a grain size distribution coefficient of variation of 0.08, each emulsion having 0.8 mol % silver bromide localized on a part of the surface of the grain) | 0.12 |
| Gelatin | 1.24 |
| Magenta Coupler (ExM) | 0.23 |
| Dye Image Stabilizer (Cpd-2) | 0.03 |
| Dye Image Stabilizer (Cpd-3) | 0.16 |
| Dye Image Stabilizer (Cpd-4) | 0.02 |
| Dye Image Stabilizer (Cpd-9) | 0.02 |
| Solvent (Solv-2) | 0.40 |
| Fourth Layer (ultraviolet-absorbing layer) | |
| Gelatin | 1.58 |
| Ultraviolet Absorbent (UV-1) | 0.47 |
| Color Stain Inhibitor (Cpd-5) | 0.05 |
| Solvent (Solv-5) | 0.24 |
| Fifth Layer (red-sensitive emulsion layer) | |
| Silver Bromochloride Emulsion (cube; average grain size: 0.58 μm; 0.6 mol % AgBr localized on a part of the surface of the grain) | 0.23 |
| Gelatin | 1.34 |
| Cyan Coupler (ExC) | 0.32 |
| Dye Image Stabilizer (Cpd-2) | 0.03 |
| Dye Image Stabilizer (Cpd-4) | 0.02 |
| Dye Image Stabilizer (Cpd-6) | 0.18 |
| Dye Image Stabilizer (Cpd-7) | 0.40 |
| Dye Image Stabilizer (Cpd-8) | 0.05 |
| Solvent (Solv-6) | 0.14 |
| Sixth Layer (ultraviolet-absorbing layer) | |
| Gelatin | 0.53 |
| Ultraviolet Absorbent (UV-1) | 0.16 |
| Color Stain Inhibitor (Cpd-5) | 0.02 |
| Solvent (Solv-5) | 0.08 |
| Seventh Layer (protective layer) | |
| Gelatin | 1.33 |
| Acryl-modified Copolymer of Polyvinyl Alcohol (modification degree: 17%) | 0.17 |
| Liquid Paraffin | 0.03 |

Yellow Coupler (ExY)

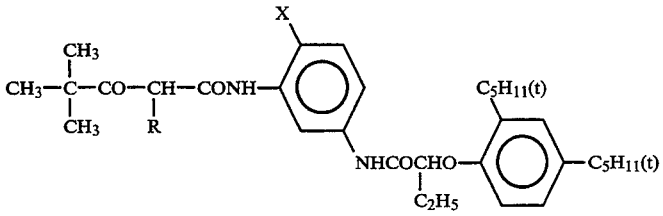

1:1 Mixture (molar ratio) of:

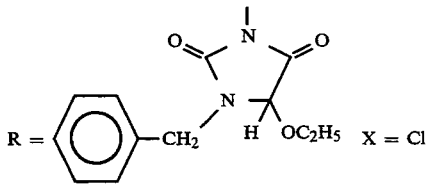

and

-continued
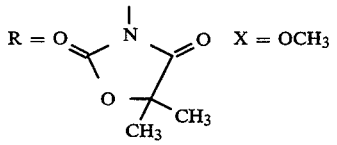
Magenta Coupler (ExM)
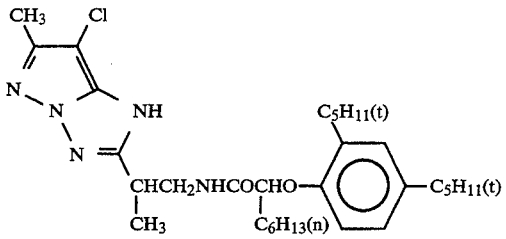
Cyan Coupler (ExC)
1:1 Mixture (molar ratio) of:
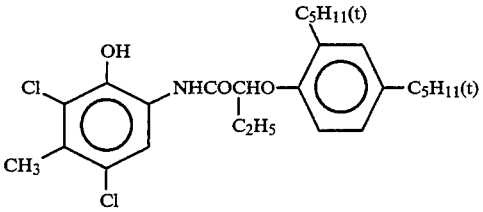
and
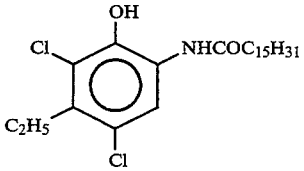
Dye Image Stabilizer (Cpd-1)
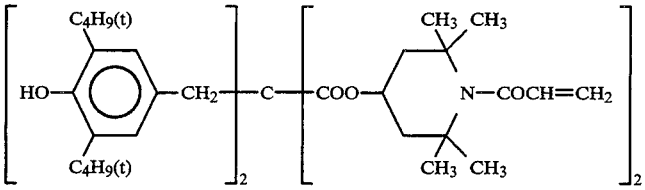
Dye Image Stabilizer (Cpd-2)
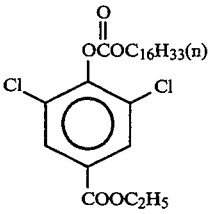
Dye Image Stabilizer (Cpd-3)

-continued
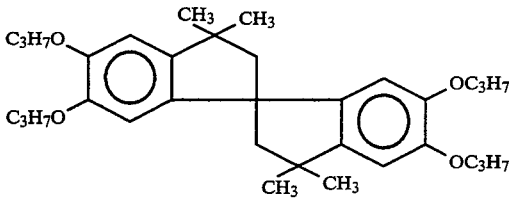
Dye Image Stabilizer (Cpd-4)
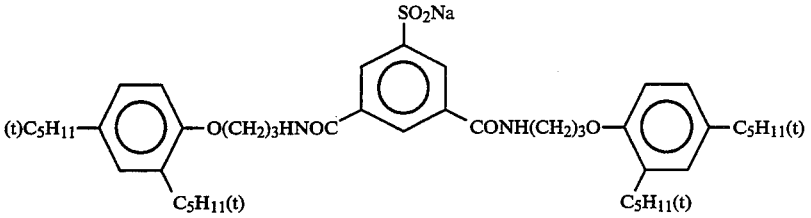
Color Stain Inhibitor (Cpd-5)
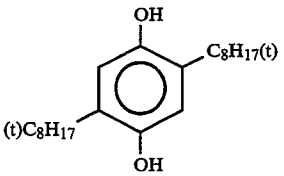
Color Stain Inhibitor (Cpd-6)
2:4:4 Mixture (by weight) of:
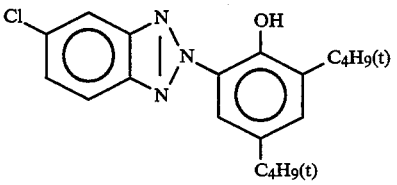
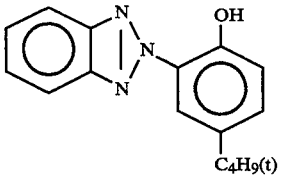
and
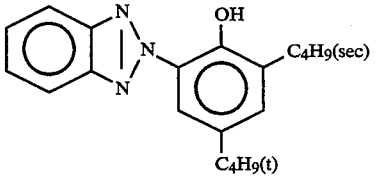
Dye Image Stabilizer (Cpd-7)
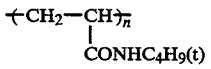
(Average molecular weight 60,000)
Dye Image Stabilizer (Cpd-8)
1:1 Mixture (by weight) of:

-continued
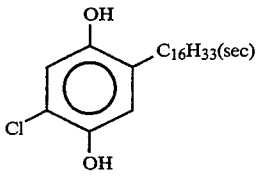
and
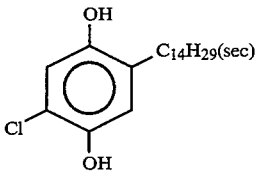
Dye Image Stabilizer (Cpd-9)
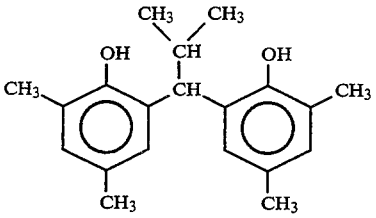
Preservative (Cpd-10)
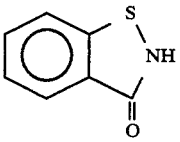
Preservative (Cpd-11)
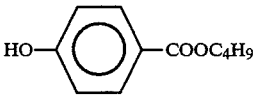
Ultraviolet Absorbent (UV-1)
4:2:4 Mixture (by weight) of:
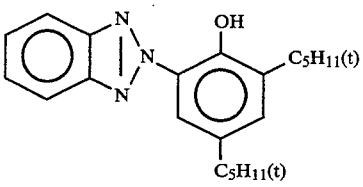
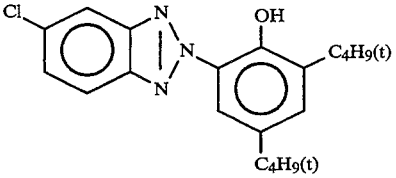
and
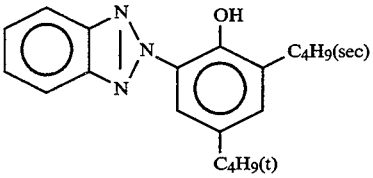
Solvent (Solv-1)
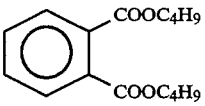

-continued

Solvent (Solv-2)
1:1 Mixture (by weight) of:

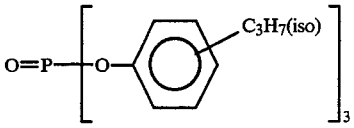

and

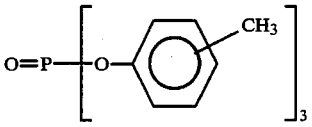

Solvent (Solv-3)

$O{=}P{+}O{-}C_9H_{19}(iso)]_3$

Solvent (Solv-4)

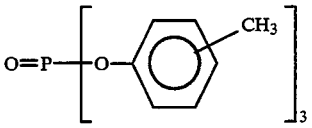

Solvent (Solv-5)

$$\begin{array}{l} COOC_8H_{17} \\ | \\ (CH_2)_8 \\ | \\ COOC_8H_{17} \end{array}$$

Solvent (Solv-6)
80:20 Mixture (by volume) of:

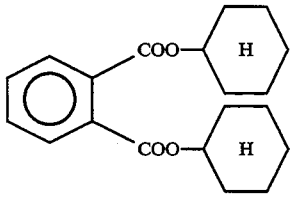

and $$C_8H_{17}\underset{\underset{O}{\backslash\,/}}{CHCH}(CH_2)_7COOC_8H_{17}$$

Solvent (Solv-7)

$$C_8H_{17}\underset{\underset{O}{\backslash\,/}}{CHCH}(CH_2)_7COOC_8H_{17}$$

The sample thus prepared was designated Sample 101. Samples 102 to 122 were then prepared in the same manner as for Sample 101 except that the sensitizing dye, reflection density and support to be used were changed as set forth in Table 2.

Sample 101 was exposed to light in such a manner that 30% of the coated amount of silver was developed. The sample thus exposed was subjected to continuous processing with the following processing solution in the following processing step using a paper processing machine until the replenishment reached twice the capacity of the color development tank. The processing solution which had passed through the continuous processing was then examined.

In order to examine the sharpness of the cyan image, Samples 101 to 122 were exposed to light through a rectangular chart for sharpness measurement using a color enlarger, and then subjected to the following processing.

CTF value ( relative value of difference of density of fine lines relative to that at 0.2 cycle/mm as 1 ) at 5 cycles/mm was determined. The results obtained are set forth in Table 3 below.

| Processing Step | Temperature | Time | Replenishment Rate* | Tank Capacity |
|---|---|---|---|---|
| Color Development | 35° C. | 45 sec. | 161 ml | 17 l |
| Blix | 30–35° C. | 45 sec. | 215 ml | 17 l |
| Rinse 1 | 30–35° C. | 20 sec. | — | 10 l |
| Rinse 2 | 30–35° C. | 20 sec. | — | 10 l |
| Rinse 3 | 30–35° C. | 20 sec. | 350 ml | 10 l |
| Drying | 70–80° C. | 60 sec. | | |

*per $m^2$ of light-sensitive material

The rinse step was effected in a countercurrent process wherein the rinse solution flowed backward (③→①).

The various processing solutions had the following compositions:

| Color Developer | Running Solution | Replenisher |
|---|---|---|
| Water | 800 ml | 800 ml |
| Ethylenediamine-N,N,N',N'-tetramethylene phosphonic Acid | 1.5 g | 2.0 g |
| Potassium Bromide | 0.015 g | — |
| Triethanolamine | 8.0 g | 12.0 g |
| Sodium Chloride | 1.4 g | — |
| Potassium Carbonate | 25 g | 25 g |
| N-Ethyl-N-(β-methanesulfonamidoethyl)-3-methyl-4-aminoaniline Sulfate | 5.0 g | 7.0 g |
| N,N-bis(Carboxymethyl) hydrazine | 4.0 g | 5.0 g |
| N,N-di(Sulfoethyl)hydroxylamine.1Na | 4.0 g | 5.0 g |
| Fluorescent Brightening Agent (WHITEX 4B, available from Sumitomo Chemical Co., Ltd.) | 1.0 g | 2.0 g |
| Water to make | 1,000 ml | 1,000 ml |
| pH (25° C.) | 10.05 | 10.45 |
| Blix Solution (The running solution was used also as replenisher) | | |
| Water | | 400 ml |
| Ammonium Thiosulfate (700 g/l) | | 100 ml |
| Sodium Sulfite | | 17 g |
| Ferric Ammonium Ethylenediaminetetraacetate.$2H_2O$ | | 55 g |
| Disodium Ethylenediaminetetraacetate | | 5 g |
| Ammonium Bromide | | 40 g |
| Water to make | | 1,000 ml |
| pH (25° C.) | | 6.0 |
| Rinse Solution (The running solution was used also as replenisher) | | |
| Ion-exchanged water (calcium and magnesium concentration: 3 ppm each) | | |

TABLE 2

| Sample No. | Support | Sensitizing Dye | Amount of Sensitizing Dye | Reflection Density* | Remarks |
|---|---|---|---|---|---|
| 101 | A | E | $0.9 \times 10^{-4}$ | 1.19 | Comparative |
| 102 | A | I-3 | $0.9 \times 10^{-4}$ | 1.23 | Present Invention |
| 103 | I | I-3 | $0.9 \times 10^{-4}$ | 1.23 | Present Invention |
| 104 | II | I-3 | $0.9 \times 10^{-4}$ | 1.24 | Present Invention |
| 105 | III | I-3 | $0.9 \times 10^{-4}$ | 1.23 | Present Invention |
| 106 | IV | I-3 | $0.9 \times 10^{-4}$ | 1.23 | Present Invention |

TABLE 2-continued

| Sample No. | Support | Sensitizing Dye | Amount of Sensitizing Dye | Reflection Density* | Remarks |
|---|---|---|---|---|---|
| 107 | V | I-3 | $0.9 \times 10^{-4}$ | 1.24 | Present Invention |
| 108 | VI | I-3 | $0.9 \times 10^{-4}$ | 1.23 | Present Invention |
| 109 | VII | I-3 | $0.9 \times 10^{-4}$ | 1.22 | Present Invention |
| 110 | IV | E | $1.8 \times 10^{-4}$ | 1.20 | Comparative |
| 111 | IV | E | $3.6 \times 10^{-4}$ | 1.20 | Comparative |
| 112 | IV | I-3 | $1.8 \times 10^{-4}$ | 1.23 | Present Invention |
| 113 | IV | I-3 | $3.6 \times 10^{-4}$ | 1.25 | Present Invention |
| 114 | IV | E | $0.9 \times 10^{-4}$ | 1.80 | Comparative |
| 115 | IV | E | $0.9 \times 10^{-4}$ | 2.42 | Comparative |
| 116 | IV | E | $0.9 \times 10^{-4}$ | 0.81 | Comparative |
| 117 | IV | E | $0.9 \times 10^{-4}$ | 0.39 | Comparative |
| 118 | IV | I-3 | $0.9 \times 10^{-4}$ | 0.83 | Present Invention |
| 119 | IV | I-3 | $0.9 \times 10^{-4}$ | 0.40 | Comparative |
| 120 | IV | I-6 | $0.9 \times 10^{-4}$ | 1.22 | Present Invention |
| 121 | IV | I-22 | $0.9 \times 10^{-4}$ | 1.22 | Present Invention |
| 122 | IV | I-32 | $0.9 \times 10^{-4}$ | 1.23 | Present Invention |

*Reflection density was determined at 680 nm.

The results show that the samples of the present invention exhibit a high CTF value for the cyan image which is provided by a combination of reflection densities due to the sensitizing dyes and the dyes of the present invention and no increase in Dmin presumably attributed to the dyes or sensitizing dyes which remained and thus can be preferably used.

It can also be seen that Samples 103, 106, 107 and 108, which have a high white pigment grain packing, such as 14% or more, and Sample 109, which comprises a support with a secondary diffusion reflectivity, exhibit a higher sharpness and thus can be advantageously used.

| Sample No. | CTF value* | Dmin* | Remarks |
|---|---|---|---|
| 101 | 0.69 | 0.10 | Comparative |
| 102 | 0.79 | 0.10 | Present Invention |
| 103 | 0.83 | 0.10 | " |
| 104 | 0.81 | 0.10 | " |
| 105 | 0.79 | 0.10 | " |
| 106 | 0.82 | 0.10 | " |
| 107 | 0.84 | 0.10 | " |
| 108 | 0.87 | 0.10 | " |
| 109 | 0.89 | 0.10 | " |
| 110 | 0.71 | 0.11 | Comparative |
| 111 | 0.70 | 0.13 | " |
| 112 | 0.79 | 0.10 | Present Invention |
| 113 | 0.80 | 0.10 | " |
| 114 | 0.71 | 0.12 | Comparative |
| 115 | 0.73 | 0.14 | " |
| 116 | 0.64 | 0.10 | " |
| 117 | 0.57 | 0.10 | " |
| 118 | 0.75 | 0.10 | Present Invention |
| 119 | 0.69 | 0.10 | Comparative |
| 120 | 0.81 | 0.10 | Present Invention |
| 121 | 0.80 | 0.10 | " |
| 122 | 0.82 | 0.10 | " |

*CTF value at the cyan color area
**Cyan density

EXAMPLE 2

To the same color developer (tank solution) as described in Example 1 were each added sodium sulfite in amounts of $2\times10^{-3}$ mol/l, $5\times10^{-3}$ mol/l and $9\times10^{-3}$ mol/l, respectively. Samples which had been exposed to light in the same manner as in Example 1 were then processed with these color developers.

The addition of sodium sulfite enables a reduction in Dmin, and the increase in the added amount of dyes present enables an increase in reflection density to be achieved. However, these approaches give a low contrast which reduces the difference in density between fine lines. Sodium sulfite is normally used to stabilize color developers. However, in the present invention, the addition of sodium suflite is not preferred.

This tendency is shown in Table 4 below. The difference in density between fine lines is represented by the absolute value of the actual density difference instead of the CTF value as in Example 1.

The incorporation of sodium sulfite in color developers advantageously reduces Dmin to improve whiteness. However, this also disadvantageously reduces the density difference between fine lines which represents image sharpness.

Sample 106 of the present invention exhibits a sufficiently low $D_{min}$ and high density difference between fine lines even at a low sodium sulfite concentration.

TABLE 4

| Test No. | Sodium Sulfite (mol/l) | Sample No. | Density Difference between Fine Lines* | Dmin** | Remarks |
|---|---|---|---|---|---|
| 1 | 0 | 101 | 0.51 | 0.10 | Comparative |
| 2 | 0 | 106 | 0.61 | 0.10 | Present Invention |
| 3 | 0 | 114 | 0.53 | 0.11 | Comparative |
| 4 | 0 | 115 | 0.55 | 0.13 | " |
| 5 | $2\times10^{-3}$ | 101 | 0.50 | 0.10 | " |
| 6 | $2\times10^{-3}$ | 106 | 0.59 | 0.10 | Present Invention |
| 7 | $2\times10^{-3}$ | 114 | 0.51 | 0.10 | Comparative |
| 8 | $2\times10^{-3}$ | 115 | 0.53 | 0.11 | " |
| 9 | $5\times10^{-3}$ | 101 | 0.48 | 0.10 | " |
| 10 | $5\times10^{-3}$ | 106 | 0.57 | 0.10 | " |
| 11 | $5\times10^{-3}$ | 114 | 0.50 | 0.10 | " |
| 12 | $5\times10^{-3}$ | 115 | 0.52 | 0.10 | " |
| 13 | $8\times10^{-3}$ | 101 | 0.47 | 0.10 | " |
| 14 | $8\times10^{-3}$ | 106 | 0.56 | 0.10 | " |
| 15 | $8\times10^{-3}$ | 114 | 0.49 | 0.10 | " |
| 16 | $8\times10^{-3}$ | 115 | 0.51 | 0.10 | " |

*Density difference at 5 cycles/mm in cyan color portion
**Cyan density

EXAMPLE 3

32 g of lime-treated gelatin was added to and dissolved in 1,000 cc of distilled water at a temperature of 40° C. 3.3 g of sodium chloride was then added to the material. The material was heated to a temperature of 60° C. To the solution was added 1.8 cc of N,N'-dimethylimidazolidine-2-thione (1% aqueous solution). A solution obtained by dissolving 32.0 g of silver nitrate in 200 cc of distilled water and a solution obtained by dissolving 11.0 g of sodium chloride in 200 cc of distilled water were added to the solution over a 14 minute period while the system was kept at a temperature of 60° C. A solution obtained by dissolving 128.0 g of silver nitrate in 560 cc of distilled water and a solution obtained by dissolving 44.0 g of sodium chloride in 560 cc of distilled water were added to the solution over a 40 minute period while the system was kept at a temperature of 60° C. The solution was desalted and rinsed at a temperature of 40° C. 90.0 g of lime-treated gelatin was added to the solution. The solution was then adjusted to a pAg of 7.5 and a pH of 6.5 with sodium chloride and sodium hydroxide. The emulsion was then optimally sulfur sensitized with triethylurea at a temperature of 50° C. to prepare a silver chloride emulsion as Emulsion A.

Prior to the sulfur sensitization of Emulsion A, an emulsion of extremely fine silver bromide grains (grain size: 0.05 μm) was added to another batch of Emulsion A in an amount of 0.8 mol % per mol of silver chloride, calculated in terms of silver bromide. The material was ripened for 15 minutes. The material was then subjected to optimum sulfur sensitization with triethylurea to prepare a silver chloride emulsion as Emulsion B.

Emulsions C-1 and C-2 were prepared in the same manner as Emulsion A except that to the aqueous solution of the alkali halide added the second time were added potassium hexacyanoferrate (II) trihydrate or potassium hexachloroiridate (IV) in amounts such that the metallic ion content reached the value set forth in Table 5 below.

Emulsions D-1 to D-3 were prepared in the same manner as Emulsion B except that to the aqueous solution of the alkali halide added the second time was added potassium hexacyanoferrate (II) trihydrate in an amount such that the iron ion content reached the value as set forth in Table 5 below.

Emulsions E-1 to E-3 were prepared in the same manner as Emulsion B except that to the emulsion of extremely fine silver bromide grains added before the sulfur sensitization of Emulsion B was added potassium hexachloroiridate (IV) during the preparation of the emulsion of extremely fine silver bromide grains in an amount such that the iridium ion content reached the value as set forth in Table 5 below so that it contained iridium ion.

Emulsions F-1 to F-3 were prepared in the same manner as Emulsion B except that to Emulsion B was added iron ions in the same manner as in D-1 to D-3, respectively, and iridium ions in the same manner as in Emulsions E-1 to E-3, respectively.

The emulsions thus prepared were then evaluated under an electron microscope for grain shape, grain size and grain size distribution. The grain size is represented by the average of the diameter of circles equivalent to the projected area of grains, and the grain size distribution is represented by the value obtained by dividing the standard deviation of the grain diameters by the average grain size (coefficient of variation). These emulsions all comprised cubic grains having a size of 0.54 μm and a size distribution coefficient of variation of 9%.

The electron micrograph of these emulsions showed that cubic grains in the emulsions comprising the emulsion of extremely fine silver bromide grains have sharper corners than Emulsion A, which did not contain the emulsion of extremely fine silver bromide grains. X-ray diffraction of these emulsions showed that they exhibit a diffraction at portions corresponding to a silver bromide content of 10 mol % to 40 mol %.

Table 5 below shows the presence or absence of localized phases and the metallic ion content in these emulsions.

TABLE 5

| Emulsion | Silver Bromide Localized Phase | Metallic Ion Present (mol/mol of Ag) Iron Ion | Iridium Ion |
|---|---|---|---|
| A | None | None | None |
| B | Yes | None | None |
| C-1 | None | $5\times10^{-6}$ | None |

TABLE 5-continued

| Emulsion | Silver Bromide Localized Phase | Metallic Ion Present (mol/mol of Ag) Iron Ion | Iridium Ion |
|---|---|---|---|
| C 2 | None | None | $1 \times 10^{-7}$ |
| D-1 | Yes | $5 \times 10^{-7}$ | None |
| D-2 | Yes | $5 \times 10^{-6}$ | None |
| D-3 | Yes | $5 \times 10^{-5}$ | None |
| E-1 | Yes | None | $1 \times 10^{-8}$ |
| E-2 | Yes | None | $1 \times 10^{-7}$ |
| E-3 | Yes | None | $1 \times 10^{-6}$ |
| F-1 | Yes | $5 \times 10^{-6}$ | $1 \times 10^{-7}$ |
| F-2 | Yes | $5 \times 10^{-6}$ | $1 \times 10^{-6}$ |
| F-3 | Yes | $5 \times 10^{-5}$ | $1 \times 10^{-6}$ |

A double polyethylene-laminated paper support was subjected to corona discharge. A gelatin subbing layer containing sodium dodecylbenzenesulfonate was coated on the support. Various photographic layers were coated on the material to prepare a multi-layer color photographic paper having the following layer structure (Sample 3-1). The coating solutions were prepared as follows:

Preparation of Fifth Layer Coating Solution

To 32.0 g of a cyan coupler (ExC), 3.0 g of a dye image stabilizer (Cpd-2), a dye image stabilizer (Cpd-4), 18.0 g of a dye image stabilizer (Cpd-6), 40.0 g of a dye image stabilizer (Cpd-7), and 5.0 g of a dye image stabilizer (Cpd-8) were added 50.0 cc of ethyl acetate and 14.0 g of a solvent (Solv-6) so that they were dissolved in these solvents. The solution was then added to 500 cc of a 20% aqueous solution of gelatin containing 8 cc of sodium dodecylbenzenesulfonate. The material was then subjected to emulsion dispersion using an ultrasonic homogenizer. The dispersion thus prepared was mixed with the silver chloride Emulsion A to prepare a coating solution for the Fifth Layer.

The coating solutions for the First to Fourth Layers, Sixth Layer and Seventh Layer were prepared in the same manner as Fifth Layer coating solution. The sodium salt of 1-oxy-3,5-dichloro-s-triazine was added to each of these layers as a gelatin hardener.

Cpd-10 and Cpd-11 were added to each of these layers in amounts of 25.0 mg/m$^2$ and 50.0 mg/m$^2$, respectively.

The silver bromochloride emulsion incorporated in the various light-sensitive emulsion layers contained the following spectral sensitizing dyes:

Sensitizing Dye A for Blue-Sensitive Emulsion Layer

-continued

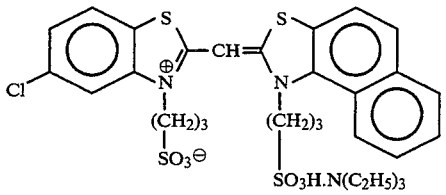

Sensitizing Dye B for Blue-Sensitive Emulsion Layer

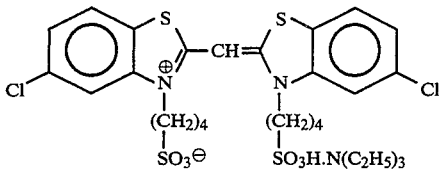

($2.0\times10^{-4}$ mol each for large grain size emulsion and $2.5\times10^{-4}$ mol each for small grain size emulsion per mol of silver halide)

Sensitizing Dye C for Green-Sensitive Emulsion Layer

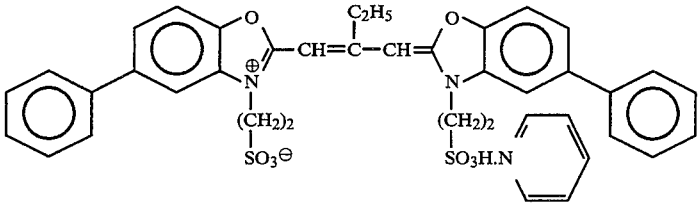

($4.0\times10^{-4}$ mol each for large grain size emulsion and $5.6\times10^{-4}$ mol each for small grain size emulsion per mol of silver halide)

Sensitizing Dye D for Green-Sensitive Emulsion Layer

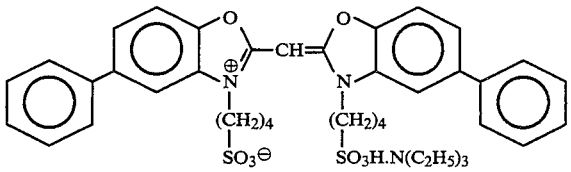

($7.0\times10^{-5}$ mol each for large grain size emulsion and $1.0\times10^{-5}$ mol each for small grain size emulsion per mol of silver halide)

Sensitizing Dye S-1 for Red-Sensitive Emulsion Layer

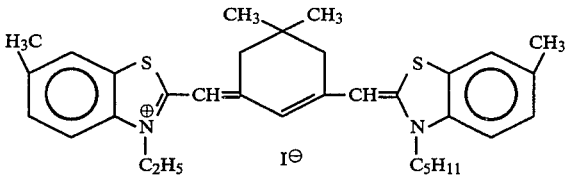

($8.0\times10^{-5}$ mol per mol of silver halide)

The following compound was incorporated in the red-sensitive emulsion layer in an amount of $2.6\times10^{-3}$ mol per mol of silver halide:

the following dyes were added to these emulsion layers (the figure in parenthesis is the coated amount).

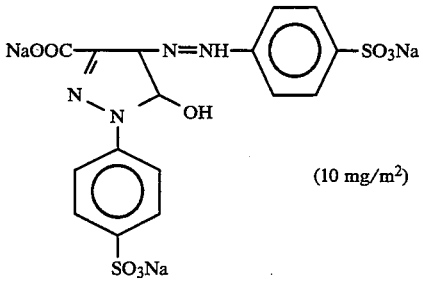

(10 mg/m²)

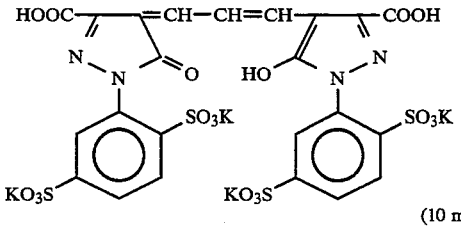

(10 mg/m²)

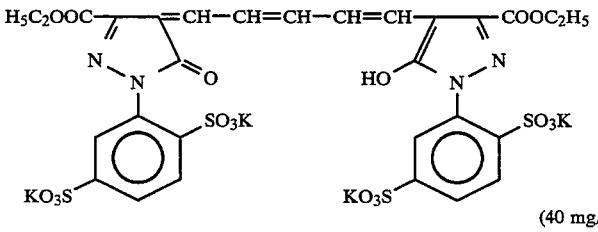

(40 mg/m²)

and

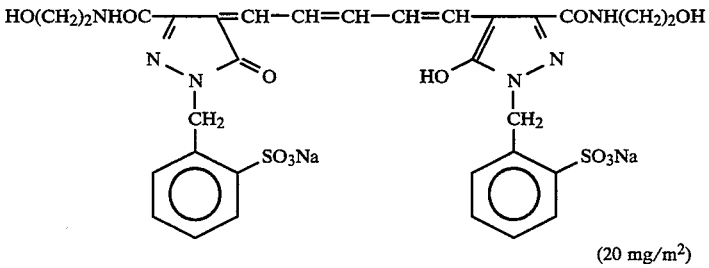

(20 mg/m²)

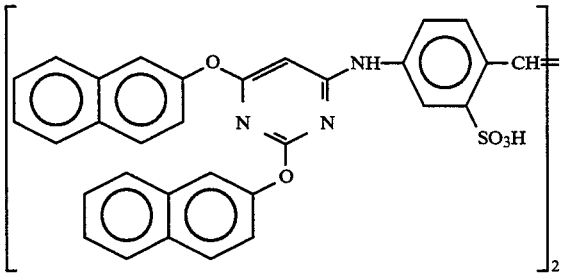

To the blue-sensitive emulsion layer, green-sensitive emulsion layer and red-sensitive emulsion layer were added 1-(5-methylureidophenyl)-5-mercaptotetrazole in amounts of $8.5\times10^{-5}$ mol, $7.7\times10^{-4}$ mol and $2.5\times10^{-4}$ mol per mol of silver halide, respectively.

To the blue-sensitive emulsion layer and green-sensitive emulsion layer were added 4-hydroxy-6-methyl-1,3,3a-tetrazaindene in amounts of $1\times10^{-4}$ mol and $2\times10^{-4}$ mol per mol of silver halide, respectively.

In order to adjust the optical reflection density of the sample on the image formation side at 680 nm to 1.10,

Layer Structure

The same compositions of the various layers as those in Example 1 are used, except for using the following silver bromochloride emulsions are used for the first layer, the third layer and the fifth layer, instead of those layers in Example 1. The figures indicate the coated amount (g/m²). The coated amount of silver halide emulsion is calculated in terms of silver.

| First Layer (blue-sensitive emulsion layer) | |
|---|---|
| Silver Bromochloride Emulsion (3:7 (molar ratio calculated in terms of silver) mixture of a large grain size emulsion comprising cubic grains with an average size of 0.88 μm and a grain size distribution coefficient of variation of 0.08 and a small grain size emulsion having cubic grains with an average size of 0.70 μm and a grain size distribution coefficient of variation of 0.10, each emulsion having 0.30 | 0.30 |

-continued

| | |
|---|---|
| mol % silver bromide localized on a part of the surface of grains) | |
| Third Layer (green-sensitive emulsion layer) | |
| Silver Bromochloride Emulsion (1:3 (molar ratio calculated in terms of silver) mixture of a large grain size emulsion comprising cubic grains with an average size of 0.55 μm and a grain size distribution fluctuation coefficient of 0.10 and a small grain size emulsion having cubic grains with an average size of 0.39 μm and a grain size distribution coefficient of variation of 0.08, each emulsion having 0.8 mol % silver bromide localized on a part of the surface of grains) | 0.12 |
| Fifth Layer (red-sensitive emulsion layer) | |
| Silver Bromochloride Emulsion A | 0.23 |

Samples 3-2 to 3-18 were prepared in the same manner as in Sample 3-1 except that the emulsion and spectral sensitizing dye incorporated in the Fifth Layer (red-sensitive layer) were changed as set forth in Table 6 below.

In order to determine how the photographic properties changed with the change in temperature upon exposure, these samples were exposed to light under the conditions of 25° C. and 40% RH and the conditions of 25° C, and 85% RH.

For these exposure processes, a sensitometer (Type FWH, available from Fuji Photo Film Co., Ltd.; color temperature of light source: 3,200° K.) was used to provide a gradation exposure using a separation filter for sensitometry.

The samples thus exposed were subjected to continuous processing using the same processing solution and the same processing steps as in Exampel 1 by means of a paper processing machine until the replenishment reached twice the capacity of the color development tank.

The color density of the samples thus processed was then evaluated to obtain characteristic curves.

For the evaluation of the change in photographic properties, the density difference ΔD was calculated for comparison in accordance with the following procedure.

i. From the characteristic curve of the sample which has been exposed to light at a temperature of 25° C. and a relative humidity of 40%, the exposure which gave a cyan image color density of 0.5 (reference density) was calculated. This exposure value was used as reference exposure.

ii. From the characteristic curve of the same sample which had been exposed to light at a temperature of 25° C. and a relative humidity of 85%, the cyan image color density, with reference exposure as obtained in the step i., was read.

iii. The reference density of 0.5 in step i. is subtracted from the color density as obtained in step ii. to calculate the density difference ΔD.

If the density difference ΔD is positive, the light-sensitive materials which have been exposed to light at a high humidity condition exhibit an increased cyan image color density, giving cyan-tinted images. On the contrary, if the density difference ΔD is negative, the light-sensitive materials exhibit a decreased cyan image color density, giving red-tinted images. Thus, the smaller the density difference ΔD is, the smaller is the change in the tint due to the humidity upon exposure. Therefore, light-sensitive materials with a small density difference are practically preferred.

The same negative image was enlarged and printed on these samples to evaluate image sharpness. The resulting prints were visually evaluated.

The results are set forth in Table 6.

TABLE 6

| | Composition of Red-Sensitive Layer | | | | |
|---|---|---|---|---|---|
| Sample | Emulsion | Spectral Sensitizing Dye | ΔD | Sharpness | Remarks |
| 3-1 | A | S-1 | 0.05 | Poor | Comparative |
| 3-2 | A | I-3 | 0.25 | Good | Comparative |
| 3-3 | B | S-1 | 0.04 | Poor | Comparative |
| 3-4 | B | I-3 | 0.23 | Good | Comparative |
| 3-5 | C-1 | I-3 | 0.22 | Good | Comparative |
| 3-6 | C-2 | I-3 | 0.23 | Good | Comparative |
| 3-7 | D-1 | S-1 | 0.04 | Poor | Comparative |
| 3-8 | D-1 | I-3 | 0.06 | Good | Present Invention |
| 3-9 | D-2 | I-3 | 0.05 | Good | Present Invention |
| 3-10 | D-3 | I-3 | 0.05 | Good | Present Invention |
| 3-11 | E-1 | S-1 | 0.05 | Poor | Comparative |
| 3-12 | E-1 | I-3 | 0.04 | Good | Present Invention |
| 3-13 | E-2 | I-3 | 0.03 | Good | Present Invention |
| 3-14 | E-3 | I-3 | 0.05 | Good | Present Invention |
| 3-15 | F-1 | S-1 | 0.04 | Poor | Comparative |
| 3-16 | F-1 | I-3 | 0.02 | Good | Present Invention |
| 3-17 | F-2 | I-3 | 0.02 | Good | Present Invention |
| 3-18 | F-3 | I-3 | 0.03 | Good | Present Invention |

Even when the optical reflection density of these light-sensitive materials at 680 nm were altered by the adjustment of the coated amount of the water-soluble dyes to 0.70 or 0.80, similar results were obtained.

Further, even when the spectral sensitizing Dye I-3 was altered to I-7, I-11, I-16, I-24, I-26, I-30 or I-43, similar results were obtained.

The results set forth in Table 6 above show that the samples, comprising a cyan image forming layer with an emulsion whose optical reflection density at 680 nm of 0.70 or more had been adjusted and which had been spectrally sensitized with a compound represented by the general formula (I) so that the samples exhibit a maximum spectral sensitivity between 680 nm and 720 nm, exhibit an improved sharpness but show a great increase in the cyan density upon exposure at high humidity. The increase in the cyan density can be by no means eliminated even if the above described emulsion includes a silver bromide localized phase or contains iron ions or iridium ions.

However, as can be seen by the results of Samples 3-8 to 3-10, 3-12 to 3-14, and 3-16 to 3-18, the use of a silver bromochloride emulsion, with a silver bromide localized phase comprising iron ions or iridium ions, inhibits the change in photographic properties due to the fluctuation in humidity upon exposure while maintaining a high sharpness. This shows that the samples of the present invention are quite excellent.

EXAMPLE 4

Emulsion G was prepared in the same manner as Emulsion B except that to the aqueous solution of alkali halide added the second time was added potassium tetrachloroplatinumate (II) so that the emulsion contained platinum ions in an amount of $5\times10^{-6}$ mol/mol of Ag.

Emulsions H and I were prepared in the same manner as Emulsion G except that sodium tetrachloropalladate (II) and hexachlororhodium ammonium were added to the system instead of potassium tetrachloroplatinate (II) so that they contained palladium ions and rhodium ions in amounts of $5\times10^{-6}$ mol/mol of Ag, respectively.

Samples 3-19 to 3-21 were prepared in the same manner as Sample 3-1 of Example 3 except that the emulsion and spectral sensitizing dye incorporated in the Fifth Layer (red-sensitive layer) were altered as set forth in Table 7 below.

The image sharpness and the change in the photographic properties due to the fluctuation in humidity upon exposure were evaluated in the same manner as in Example 3. As a result, it was found that the addition of platinum ions, palladium ions or rhodium ions also inhibits the change in photographic properties due to the fluctuation in humidity upon exposure while maintaining a high sharpness.

TABLE 7

| | Composition of Red-Sensitive Layer | | | | |
|---|---|---|---|---|---|
| Sample | Emulsion | Spectral Sensitizing Dye | ΔD | Sharpness | Remarks |
| 3-3 | B | S-1 | 0.04 | Poor | Comparative |
| 3-4 | B | I-3 | 0.23 | Good | Comparative |
| 3-19 | G | S-1 | 0.04 | Poor | Comparative |
| 3-20 | G | I-3 | 0.05 | Good | Present Invention |
| 3-21 | H | S-3 | 0.05 | Poor | Comparative |
| 3-22 | H | I-3 | 0.06 | Good | Present Invention |
| 3-23 | I | S-1 | 0.05 | Poor | Comparative |
| 3-24 | I | I-3 | 0.04 | Good | Present Invention |

EXAMPLE 5

Thirteen emulsions were prepared in the same manner as in Example 3 except that gold sensitization with tetrachloroauric (III) tetrahydrate was effected instead of sulfur sensitization with triethylthiourea. Light-sensitive materials were then prepared from these emulsions in the same manner as in Example 3. The image sharpness and change in photographic properties due to the fluctuation in humidity upon exposure of these light-sensitive materials were evaluated. Results similar to those of Example 3 were obtained.

EXAMPLE 6

Thirteen emulsions were prepared in the same manner as in Example 3 except that the emulsion used in Example 3 was subjected to gold sensitization with auric tetrachloride (III) tetrahydrate. Light-sensitive materials were then prepared from these emulsions in the same manner as in Example 3. The image sharpness and change in photographic properties due to the fluctuation in humidity upon exposure of these light-sensitive materials were evaluated. Results similar to those of Example 3 were obtained.

EXAMPLE 7

A double polyethylene-laminated paper support was subjected to corona discharge. A gelatin subbing layer containing dodecylbenzenesulfonic acid was coated on the support. Various photographic layers were coated on the material to prepare a multi-layer color photographic paper having the following layer structure (Sample 4-0). The coating solutions were prepared as follows:

Preparation of Fifth Layer Coating Solution

To 9.6 g of a cyan coupler (ExC), 0.6 g of a dye image stabilizer (Cpd-2), 0.4 g of a dye image stabilizer (Cpd-4), 5.4 g of a dye image stabilizer (Cpd-6), 12 g of a dye image stabilizer (Cpd-7), and 1.5 g of a dye image stabilizer (Cpd-8) were added 25.0 cc of ethyl acetate and 4.2 g of a solvent (Solv-6) so that they dissolved in these solvents. The solution was then emulsion-dispersed in 402 cc of a 10% aqueous solution of gelatin containing 20.0 cc of sodium dodecylbenzenesulfonate. On the other hand, a silver bromochloride Emulsion C (1:4 (molar ratio, calculated in terms of silver) mixture of a large grain size Emulsion C comprising cubic grains with an average size of 0.58 μm and a grain size distribution coefficient of variation of 0.09 and a small grain size emulsion having cubic grains with an average size of 0.45 μm and a grain size distribution coefficient of variation of 0.11, each emulsion having 0.6 mol % silver bromide localized on a part thereof). To this emulsion was added a red-sensitive sensitizing dye as set forth below during the chemical ripening in amounts of $2.7\times10^{-4}$ mol for the large grain size emulsion and $3.3\times10^{-4}$ mol for the small grain size emulsion. This emulsion was sensitized with a sulfur sensitizing agent and gold sensitizing agent. The above described emulsion dispersion C and this silver bromochloride emulsion were dissolved in admixture to prepare a coating solution for the Fifth Layer having the composition as set forth below.

The coating solutions for the First to Seventh Layers were prepared in the same manner as the Fifth and Sixth Layer coating solutions. The sodium salt of 1-oxy-3,5-dichloro-s-triazine was added to each of these layers as a gelatin hardener. The total coated amount of the gelatin hardener was 0.097 g/m$^2$.

To each of these layers was added Cpd-10 and Cpd-11 in amounts of 25.0 mg/m$^2$ and 50.0 mg/m$^2$, respectively.

The silver bromochloride emulsion incorporated in the various light-sensitive emulsion layers included the following spectral sensitizing dyes:

Sensitizing Dye A for Blue-Sensitive Emulsion Layer

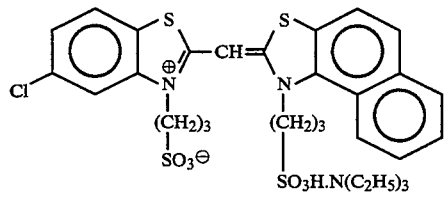

Sensitizing Dye B for Blue-Sensitive Emulsion Layer

-continued

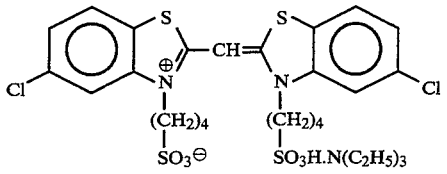

($2.0\times10^{-4}$ mol each for large grain size emulsion A and $2.5\times10^{-4}$ mol each for small grain size emulsion A and mol of silver halide)

Sensitizing Dye C for Green-Sensitive Emulsion Layer

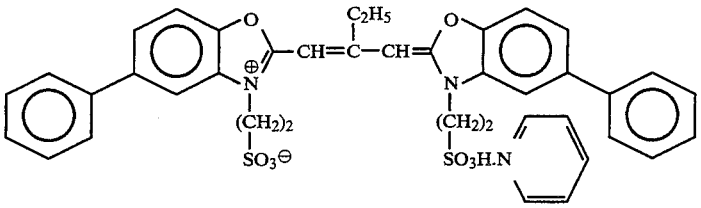

($4.0\times10^{-4}$ mol each for large grain size Emulsion B and $5.6\times10^{-4}$ mol each for small grain size Emulsion B per mol of silver halide)

Sensitizing Dye D for Green-Sensitive Emulsion Layer

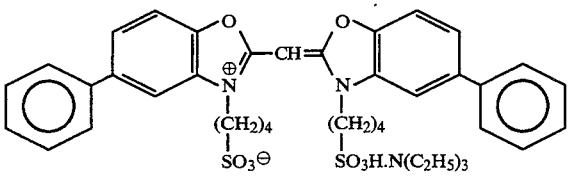

($7.0\times10^{-5}$ mol each for large grain size Emulsion B and $1.0\times10^{-5}$ mol each for small grain size Emulsion B per mol of silver halide)

Sensitizing Dye E for Red-Sensitive Emulsion Layer

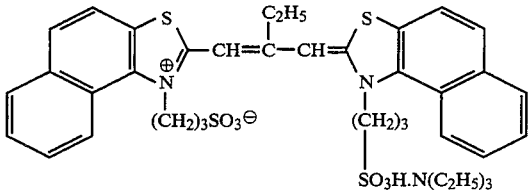

($2.7\times10^{-4}$ mol each for large grain size Emulsion C and $3.3\times10^{-4}$ each for small grain size Emulsion C per mol of silver halide)

To the blue-sensitive emulsion layer, the green-sensitive emulsion layer and the red-sensitive emulsion layer were added 1-( 5-methylureidephenyl )-5-mercaptotetrazole in amounts of $8.5\times10^{-5}$ mol, $7.7\times10^{-4}$ mol and $2.5\times10^{-4}$ mol per mol of silver halide, respectively.

To the blue-sensitive emulsion layer and the green-sensitive emulsion layer were added 4-hydroxy-6-methyl-1,3,3a-tetrazaindene in amounts of $1\times10^{-4}$ mol and $2\times10^{-4}$ mol per mol of silver halide, respectively.

The following dyes were each added to the emulsion layers in order to inhibit irradiation (the figure in parenthesis indicates the coated amount):

(Dye-1)

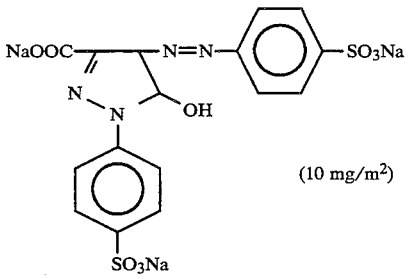

(10 mg/m$^2$)

(Dye-2)

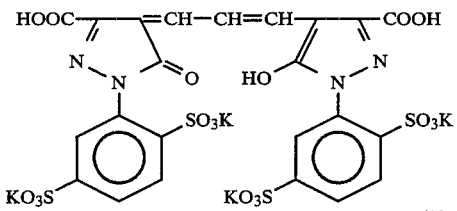

(10 mg/m$^2$)

-continued

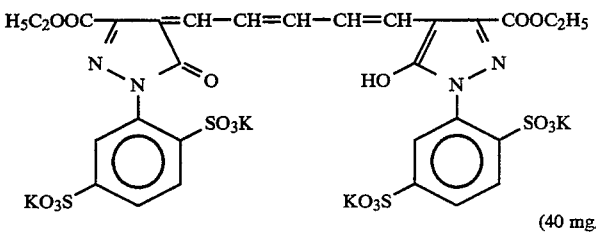

(Dye-3)

(40 mg/m²)

and

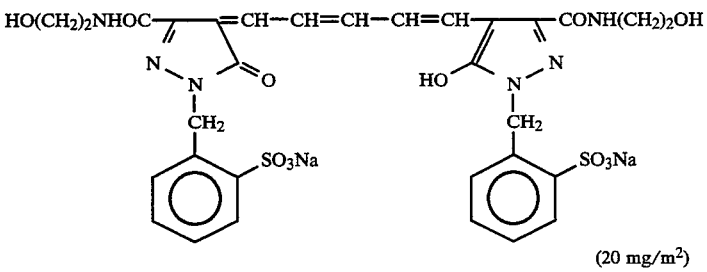

(Dye-4)

(20 mg/m²)

Layer Structure

The same compositions of the various layers as those in Example 1 are used, except for using the following silver bromochloride emulsions are used for the first layer, the third layer and the fifth layer, instead of those layers in Example 1. The figures show the coated amount (g/m²). The coated amount of silver halide emulsion as calculated in terms of silver.

| | |
|---|---|
| First Layer (blue-sensitive emulsion layer) | |
| Silver Bromochloride Emulsion (3:7 (molar ratio calculated in terms of silver) mixture of a large grain size Emulsion A comprising cubic grains with an average size of 0.88 μm and a grain size distribution coefficient of variation of 0.08 and a small grain size Emulsion A having cubic grains with an average size of 0.70 μm and a grain size distribution coefficient of variation of 0.10, each emulsion having 0.30 mol % silver bromide localized on part of the surface of the grains) | 0.30 |
| Third Layer (green-sensitive emulsion layer) | |
| Silver Bromochloride Emulsion (1:3 (molar ratio calculated in terms of silver) mixture of a large grain size Emulsion B comprising cubic grains with an average size of 0.55 μm and a grain size distribution coefficient of variation of 0.10 and a small grain size Emulsion B having cubic grains with an average size of 0.39 μm and a grain size distribution coefficient of variation of 0.08, each emulsion having 0.8 mol % silver bromide localized on a part of the surface of the grains) | 0.12 |
| Fifth Layer (red-sensitive emulsion layer) | |
| Silver Bromochloride Emulsion (1:4 (molar ratio calculated in terms of silver) mixture of a large grain size Emulsion C comprising cubic grains with an average size of 0.58 μm and a grain size distribution coefficient of variation of 0.09 | 0.23 |

-continued

| |
|---|
| and a small grain size Emulsion C having cubic grains with an average size of 0.45 μm and a grain size distribution coefficient of variation of 0.11, each emulsion having 0.6 mol % silver bromide localized on a part of the surface of the grains) |

A sensitometer (Type FWH, available from Fuji Photo Film Co., Ltd.; color temperature of light source: 3,200° K.) was used to gradation expose these sample with a separation filter for sensitometry. The exposure was effected such that an exposure of 250 CMS was obtained with a 0.1-second exposure.

The samples thus exposed were subjected to continuous processing with the same processing solution in the same processing steps as in Exampel 1 using a paper processing machine until the replenishment reached twice the capacity of the color development tank (running test).

Samples 4-1 to 4-16 were prepared in the same manner as Sample 4-0 except that the amount of the anti-irradiation dye (Dye-3) added, the coated amount of silver in each layer, and the red-sensitive sensitizing dye incorporated in the silver bromochloride emulsion inthe Fifth layer were altered as set forth in Table 8. The sharpness and stain developed after processing in the white background of these samples were evaluated.

To evaluate sharpness, a CTF value was used. CTF represents attenuation of the amplitude with respect to space frequency as a rectangular waveform. In the present invention, sharpness at a space frequency of 15 lines/mm was employed. The greater this value is, the higher is sharpness.

To evaluate stain, the samples which had been developed were stored at a temperature of 60° C. and a relative humidity of 70% for 7 days. The change in white light density in the background in these samples were then determined.

The results obtained are set forth in Tables 7 and 8.

S-1)
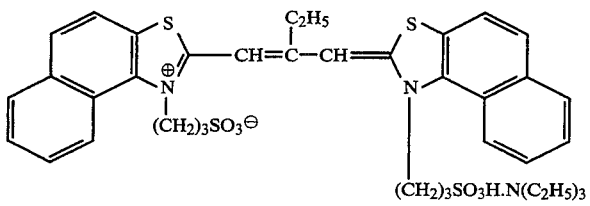
(S-2)
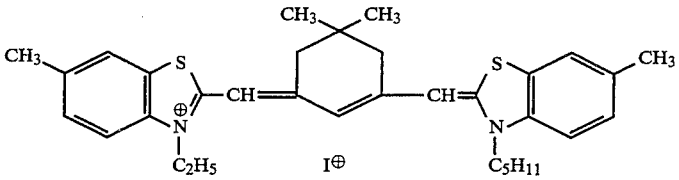
(S-3)
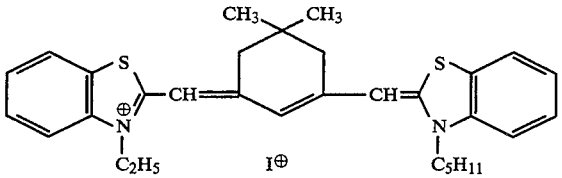
(S-4)
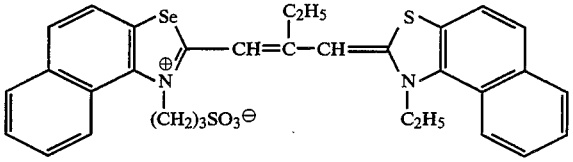
(S-5)
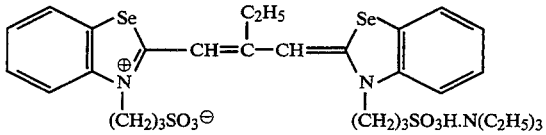
(S-6)
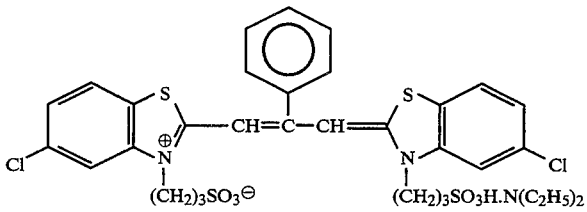
(Dye-3)
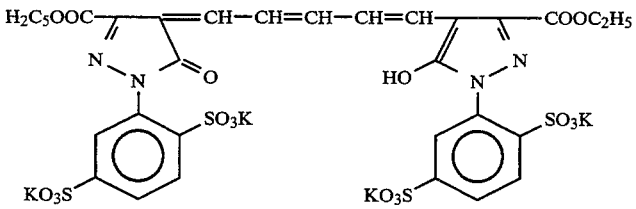
TABLE 7
| Sample No. | Red-Sensi-tizing Dye | Coated Amount of Dye (Dye-4) (mg/m$^2$) | Optical Density at 680 nm | Coated Amount of Silver (g/m$^2$) First Layer | Third Layer | Fifth Layer | Total |
|---|---|---|---|---|---|---|---|
| 4-1 | S-1 | 5 | 0.50 | 0.40 | 0.13 | 0.25 | 0.78 |
| 4-2 | " | " | " | 0.47 | 0.13 | 0.25 | 0.85 |
| 4-3 | " | " | " | 0.35 | " | 0.22 | 0.70 |
| 4-4 | " | — | 0.40 | 0.30 | 0.12 | 0.23 | 0.65 |
| 4-5 | " | 15 | 0.70 | 0.40 | 0.13 | 0.25 | 0.78 |
| 4-6 | " | 35 | 1.00 | " | " | " | " |
| 4-7 | " | 80 | 2.00 | 0.47 | " | " | 0.85 |

TABLE 7-continued

| Sample No. | Red-Sensitizing Dye | Coated Amount of Dye (Dye-4) (mg/m²) | Optical Density at 680 nm | Coated Amount of Silver (g/m²) First Layer | Third Layer | Fifth Layer | Total |
|---|---|---|---|---|---|---|---|
| 4-8 | S-2 | 5 | 0.50 | 0.40 | " | " | 0.78 |
| 4-9 | " | " | " | 0.30 | 0.12 | 0.23 | 0.65 |
| 4-10 | " | 80 | 2.00 | " | " | " | " |
| 4-11 | S-3 | 5 | 0.50 | 0.40 | 0.13 | 0.25 | 0.78 |
| 4-12 | S-4 | " | " | " | " | " | " |
| 4-13 | S-5 | " | " | " | " | " | " |
| 4-14 | S-6 | " | " | " | " | " | " |
| 4-15 | S-1 | " | " | 0.44 | " | 0.21 | " |
| 4-16 | " | " | " | 0.35 | " | 0.30 | " |

TABLE 8

| Sample No. | CTF(R) | Stain | Remarks |
|---|---|---|---|
| 4-1 | 0.35 | 0.05 | Present Invention |
| 4-2 | 0.18 | 0.07 | Comparative |
| 4-3 | 0.38 | 0.04 | Present Invention |
| 4-4 | 0.18 | 0.04 | Comparative |
| 4-5 | 0.36 | 0.06 | Present Invention |
| 4-6 | 0.39 | 0.07 | " |
| 4-7 | 0.25 | 0.25 | Comparative |
| 4-8 | 0.10 | 0.06 | " |
| 4-9 | 0.10 | 0.06 | " |
| 4-10 | 0.14 | 0.27 | " |
| 4-11 | 0.10 | 0.06 | " |
| 4-12 | 0.35 | 0.06 | Present Invention |
| 4-13 | 0.34 | 0.06 | " |
| 4-14 | 0.35 | 0.06 | " |
| 4-15 | 0.39 | 0.04 | " |
| 4-16 | 0.30 | 0.04 | " |

A comparison of the results obtained with Samples 4-1 to 4-6 shows that the adjustment of the coated amount of silver to 0.78 g/m² or less provides improvements in sharpness. It can also be seen that if the optical reflection density at 680 nm is 0.50 or less, even reduction in the coated amount of silver cannot provide a sufficient improvement in sharpness.

A comparison of the results with Samples 4-1, 4-2 and 4-7 shows that if the coated amount of silver is 0.78 g/m² or more, even an increase in the optical reflection density at 680 nm due to an increase in the coated amount of dye can provide a sufficient improvement in sharpness but aggravates stain in the white background.

It is further shown that if a sensitizing dye which does not form a J-band as in Samples 4-8 to 4-11, the sharpness level achieved by adjustment of the coated amount of silver and optical reflection density is low while that attained by the sensitizing dyes used in the present invention is high as in Samples 4-12 to 4-14.

The comparison of the results with Samples 4-1, 4-15 and 4-16 shows that a marked improvement in sharpness can be obtained particularly when the coated amount of silver in the Fifth Layer is 0.25 g/m² or less.

The above results further show that only the present invention provides a silver halide color photographic material with excellent sharpness and little aggravation in stain after processing.

In accordance with the present invention, a silver halide color photographic material which has excellent cyan image sharpness, excellent whiteness in the nonimage area, high sensitivity and excellent rapid-developability can be obtained. Further, a color image formation process which can rapidly provide a high sensitivity color photographic having excellent cyan image sharpness and whiteness in the nonimage area can be obtained.

In accordance with the present invention, a silver halide photographic material is provided which has an excellent image sharpness and a marked inhibition of fluctuation in photographic properties due to fluctuation in humidity upon exposure.

In accordance with the present invention, a silver halide color photographic material with excellent image sharpness and little aggravation in stain in white background due to a prolonged storage after processing.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a reflective support having thereon a yellow dye image forming silver halide emulsion layer, a magenta dye image forming silver halide emulsion layer and a cyan dye image forming silver halide emulsion layer, wherein said yellow dye image forming layer, magenta dye image forming layer and cyan dye image forming layer exhibit a maximum spectral sensitivity in the range of 400 to 490 nm, 530 to 570 nm and 660 to 720 nm, respectively, said silver halide emulsion of said cyan dye image forming layer comprises a silver chloride, silver bromochloride or silver bromochloroiodide emulsion having a silver chloride content of 90 mol % or more with a maximum spectral sensitivity given by J-band absorption of a compound represented by the general formula (I),

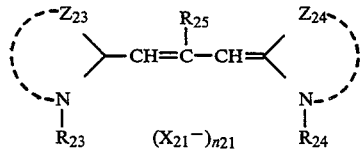

(I)

wherein $Z_{23}$ and $Z_{24}$ each represents an atomic group required to form a heterocyclic nucleus selected from the group consisting of a benzothiazole nucleus, a benzoselenazole nucleus, a naphthothiazole nucleus and a naphthoselenazole nucleus which may be substituted with one or more of a halogen atom, an alkyl group, an alkoxy group, an aryl group and a hydroxyl group, with the proviso that of said substituents, two alkyl groups may form a ring; $R_{25}$ represents a hydrogen atom, an alkyl group or an aryl group; $R_{23}$ and $R_{24}$ each represents a substituted or unsubstituted alkyl group; $X_{21}$ represents an ion for electrical neutrality; and $n_{21}$ represents an integer 0 or 1, with the proviso that when one of $R_{23}$ and $R_{24}$ forms an intramolecular salt with a quaternized nitrogen atom, $n_{21}$ is 0, and the optical reflection density of said photographic material at 680 nm is 0.70 or more.

2. A silver halide color photographic material as claimed in claim 1, wherein said support is a reflective support comprising a hydrophobic resin or a substrate covered with a hydrophobic resin and containing white pigment grains in an amount of 14% by weight or more in said hydrophobic resin layer on the side on which said silver halide emulsion layer is coated.

3. A silver halide color photographic material as claimed in claim 1, wherein said support is a reflective support having secondary diffusion reflectivity.

4. A silver halide color photographic material as claimed in claim 1, wherein the silver bromochloride grains of said cyan dye image forming layer are grains with a silver chloride content of 95 mol % or more comprising a silver bromide localized phase having a silver bromide content of at least 10 mol % in the vicinity of the surface thereof and containing ions of at least one metal selected from the group consisting of group VIII metals, group III metals, lead and thallium.

5. A silver halide color photographic material as claimed in claim 4, wherein the emulsion of said cyan dye image forming light-sensitive layer is an emulsion sensitized with a sulfur sensitizing compound.

6. A silver halide color photographic material as claimed in claim 4, wherein the emulsion of said cyan dye image forming light-sensitive layer is an emulsion sensitized with a gold sensitizing compound.

7. A silver halide color photographic material as claimed in claim 4, wherein the emulsion of said cyan dye image forming light-sensitive layer is an emulsion sensitized with a sulfur sensitizing compound and a gold sensitizing compound.

8. A silver halide color photographic material comprising a reflective support having thereon a yellow dye image forming silver halide emulsion layer, a magenta dye image forming silver halide emulsion layer and a cyan dye image forming silver halide emulsion layer, wherein said yellow dye image forming layer, magenta dye image forming layer and cyan dye image forming layer exhibit a maximum spectral sensitivity in the range of 400 to 490 nm, 530 to 570 nm and 660 to 720 nm, respectively, said silver halide emulsion of said cyan dye image forming layer comprises a silver chloride, silver bromochloride or silver bromochloroiodide emulsion having a silver chloride content of 90 mol % or more with a maximum spectral sensitivity given by J-band absorption of a compound represented by the general formula (I),

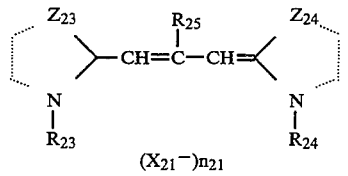

(I)

wherein $Z_{23}$ and $Z_{24}$ each represents an atomic group required to form a heterocyclic nucleus selected from the group consisting of a benzothiazole nucleus, a benzoselenazole nucleus, a naphthothiazole nucleus and a naphthoselenazole nucleus which may be substituted with one or more of a halogen atom, an alkyl group, an alkoxy group, an aryl group and a hydroxyl group, with the proviso that of said substituents, two alkyl groups may form a ring; $R_{25}$ represents a hydrogen atom, an alkyl group or an aryl group; $R_{23}$ and $R_{24}$ each represents a substituted or unsubstituted alkyl group; $X_{21}$ represents an ion for electrical neutrality; and $n_{21}$ represents an integer 0 or 1, with the proviso that when one of $R_{23}$ and $R_{24}$ forms an intramolecular salt with a quaternized nitrogen atom, $n_{21}$ is 0 and the optical reflection density thereof at 680 nm is 0.50 or more and the total coated amount of silver halide emulsion on said support is adjusted to 0.78 g/m$^2$ or less, calculated in terms of silver.

9. A silver halide color photographic material as claimed in claim 8, wherein the total coated amount of the silver halide emulsion of said cyan image forming layer is 0.25 g/m$^2$ or less, calculated in terms of silver.

* * * * *